US012227964B2

(12) United States Patent
Jakic et al.

(10) Patent No.: US 12,227,964 B2
(45) Date of Patent: Feb. 18, 2025

(54) MODULAR COOLING TOWER STRUCTURE, DESIGN, AND METHOD OF ASSEMBLY

(71) Applicant: Marmon Industrial Water Limited, Burlington (CA)

(72) Inventors: John Jakic, Burlington (CA); Robert Vertesi, Hamilton (CA); Jeffrey Garry Ianni, Toronto (CA); Timothy Scott Anderson, Edmonton (CA)

(73) Assignee: Marmon Industrial Water Limited, Burlington (CA)

( * ) Notice: Subject to any disclaimer, the term of this patent is extended or adjusted under 35 U.S.C. 154(b) by 0 days.

(21) Appl. No.: 18/002,925

(22) PCT Filed: Apr. 13, 2022

(86) PCT No.: PCT/CA2022/050575

§ 371 (c)(1),
(2) Date: Dec. 22, 2022

(87) PCT Pub. No.: WO2023/197055

PCT Pub. Date: Oct. 19, 2023

(65) Prior Publication Data

US 2024/0102306 A1 Mar. 28, 2024

(51) Int. Cl.
*E04H 5/12* (2006.01)
*E04G 21/14* (2006.01)

(52) U.S. Cl.
CPC ..... *E04H 5/12* (2013.01); *E04G 21/142* (2013.01)

(58) Field of Classification Search
CPC ..... E04B 1/35; E04B 1/3511; F03D 7/048; E04G 21/22; E04G 21/142; E04H 5/12; E04H 5/10; E02D 27/32
See application file for complete search history.

(56) References Cited

U.S. PATENT DOCUMENTS 2,794,336 A * 6/1957 Ballou ..... E04G 21/142 52/27
3,787,020 A * 1/1974 Avery ..... E04G 19/003 249/188

(Continued)

FOREIGN PATENT DOCUMENTS

CA 3081684 6/2019
CN 103863938 9/2015

(Continued)

OTHER PUBLICATIONS

SPX Cooling Technologies, Inc., "Cooling Solutions for Chemical Process Plants" Process Cooling Magazine, Apr. 2017 <https://www.spxcooling.com/news/cooling-solutions-for-chemical-process-plants/>.

(Continued)

*Primary Examiner* — Theodore V Adamos
(74) *Attorney, Agent, or Firm* — DeLio Peterson & Curcio LLC; Robert Curcio

(57) ABSTRACT

A method of designing a modular cooling tower cell which may utilize mechanicals from a preexisting cell and assembling the modular cell within a cooling field in-situ using a series of custom modules. After collecting a data set from a preexisting cooling tower cell and removing the preexisting tower, a build specification is generated, including calculating a cut list for vertical and horizontal members which will form the basis of the plurality of modules forming the cell. The members are fabricated and include a plurality of connection points which allow for sizing adjustments without affecting the connection points. The modules are then constructed using the data set from the preexisting tower to form a plurality of modules comprising a cell matrix based on the data set from the preexisting cooling tower cell.

7 Claims, 29 Drawing Sheets

(56) References Cited

U.S. PATENT DOCUMENTS

| | | | | |
|---|---|---|---|---|
| 3,993,341 | A * | 11/1976 | Bentley | E04B 5/10 52/587.1 |
| 4,712,697 | A * | 12/1987 | McGowan | E04C 3/08 212/199 |
| 5,902,522 | A * | 5/1999 | Seawell | E04H 5/12 261/DIG. 11 |
| 6,991,274 | B2 | 1/2006 | Brooks | |
| 8,297,344 | B2 | 10/2012 | Vouche | |
| 8,578,680 | B2 | 11/2013 | Abeln et al. | |
| 8,984,842 | B2 | 3/2015 | Muder | |
| 9,091,485 | B2 | 7/2015 | Bugler, III et al. | |
| 9,145,285 | B1 * | 9/2015 | Finfrock | E04G 21/167 |
| 9,739,069 | B2 | 8/2017 | Jiang et al. | |
| 10,101,100 | B2 | 10/2018 | Powell et al. | |
| 10,302,377 | B2 * | 5/2019 | Powell | F28F 25/082 |
| 10,495,391 | B2 | 12/2019 | Speckin et al. | |
| 10,907,900 | B2 | 2/2021 | Bugler et al. | |
| 10,982,904 | B2 | 4/2021 | Bugler et al. | |
| 11,035,594 | B2 | 6/2021 | Liebendorfer et al. | |
| 11,079,187 | B2 | 8/2021 | Rasmussen et al. | |
| 11,131,507 | B2 | 9/2021 | Bugler, III et al. | |
| 11,306,970 | B2 * | 4/2022 | Klaba | F28B 1/06 |
| 2004/0025466 | A1 | 2/2004 | Hink et al. | |
| 2006/0053727 | A1 * | 3/2006 | Bland | E04C 3/28 261/DIG. 11 |
| 2015/0130092 | A1 * | 5/2015 | Powell | F28F 25/082 29/890.03 |
| 2017/0002583 | A1 * | 1/2017 | Jiang | E04H 5/12 |
| 2017/0003087 | A1 * | 1/2017 | Jiang | F28F 9/0075 |
| 2017/0003088 | A1 | 1/2017 | Jiang et al. | |
| 2019/0048601 | A1 * | 2/2019 | Jablonsky | E04G 21/142 |
| 2019/0170459 | A1 * | 6/2019 | Rasmussen | F28F 25/04 |
| 2019/0309966 | A1 * | 10/2019 | Klaba | F24F 5/0007 |
| 2020/0158438 | A1 | 5/2020 | Nevins et al. | |
| 2021/0372116 | A1 * | 12/2021 | Hillenburg | F25J 3/0489 |
| 2023/0151621 | A1 * | 5/2023 | Sollenberger | E04G 3/243 256/65.14 |

FOREIGN PATENT DOCUMENTS

| | | |
|---|---|---|
| EP | 3004777 | 4/2016 |
| GB | 1419623 | 12/1975 |
| KR | 20160042183 | 4/2016 |

OTHER PUBLICATIONS

PCT International Search Report and Written Opinion for International Application No. PCT/CA2022/050575 dated Nov. 15, 2022.

* cited by examiner

FIG. 28A
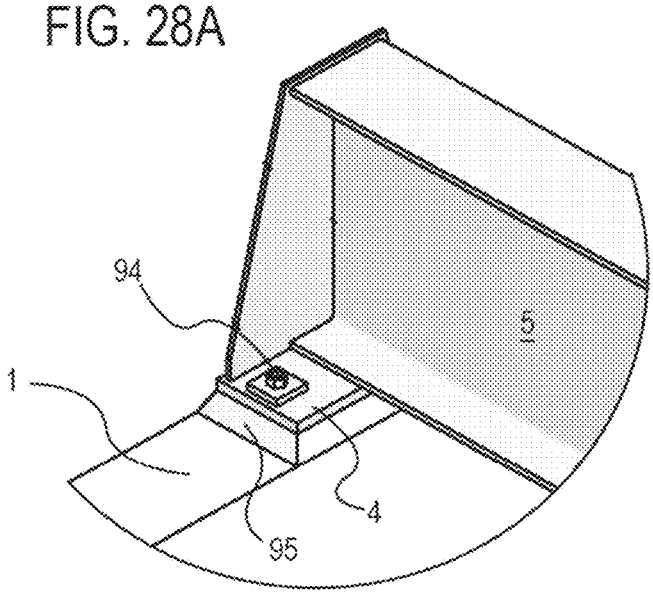
FIG. 28B
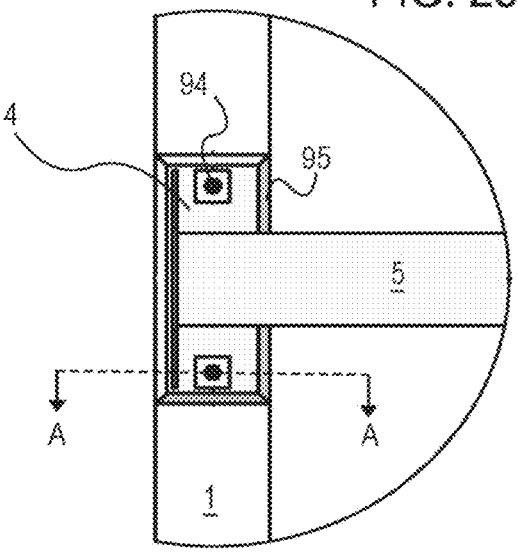
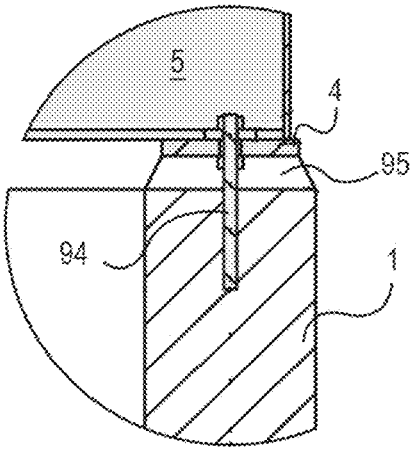
FIG. 28C

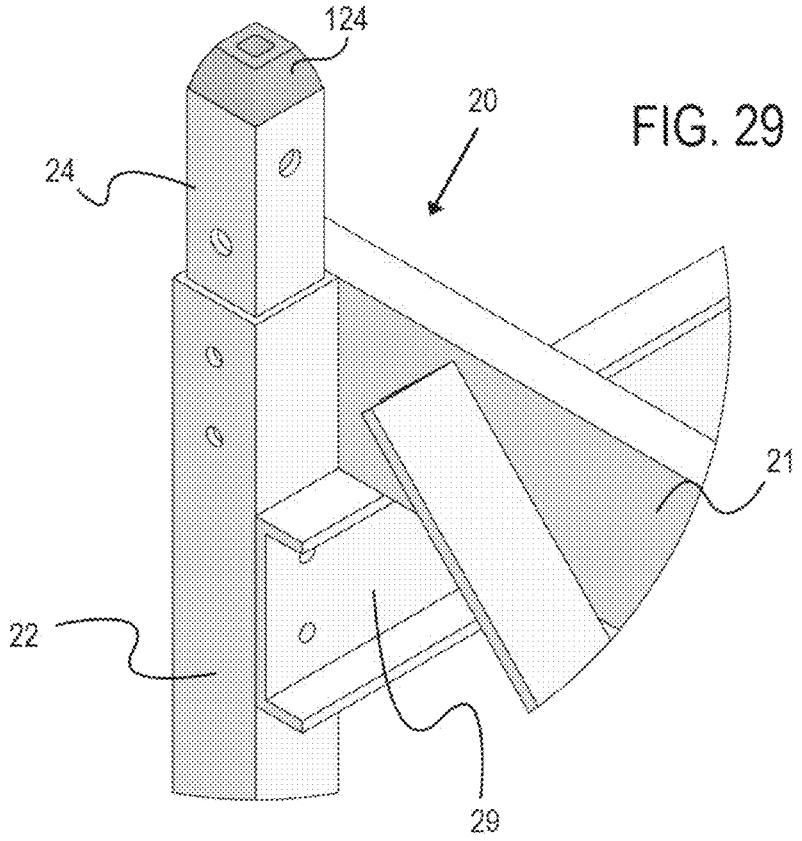
FIG. 29
FIG. 30B
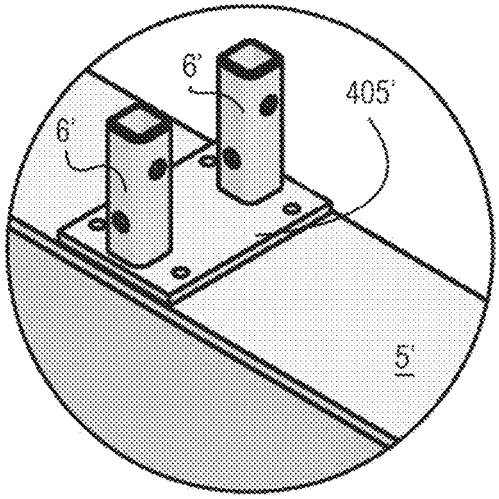
FIG. 30A
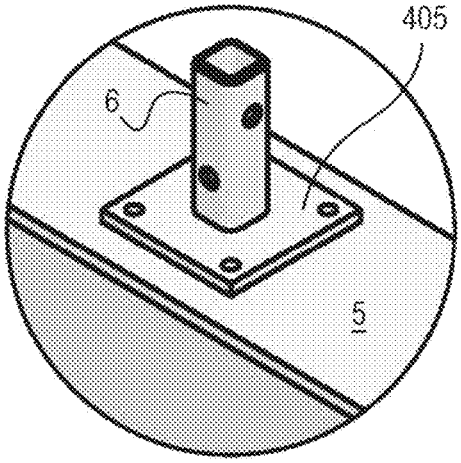

MODULAR COOLING TOWER STRUCTURE, DESIGN, AND METHOD OF ASSEMBLY

BACKGROUND OF THE INVENTION

1. Field of the Invention

The present invention relates to a cooling tower or heat exchanger, and a method and apparatus for the construction and erection thereof. More particularly, the present invention relates to the construction of a modularized cooling tower, specialized components to facilitate a modular assembly, and the method of construction and assembly.

2. Description of Related Art

Cooling towers are heat exchangers of a type widely used to emanate low grade heat into the atmosphere and are typically utilized in industrial plants, petrochemical plants, power plants, light industrial facilities, and the like. These towers receive a relatively warm or hot fluid and pass the fluid through the tower apparatus so that heat is extracted from the fluid by interaction with relatively cooler ambient air.

Cooling towers are generally identified in two types or categories, designed as counter-flow cooling towers or cross-flow cooling towers. In a counter-flow cooling tower, liquid of high temperature is cooled as it flows downwards through fill or packing and is brought into contact with air traveling upwards. Conversely, in a cross-flow cooling tower, liquid of high temperature is cooled with air that moves horizontally through the fill or packing. The heated air is exhausted into the atmosphere using a fan, blower, or other such air moving device, and the cooled liquid is collected in a basin situated below the media fill or packing and water distribution piping system.

Liquid is generally distributed through a cooling tower in one of two ways: gravity and spray. Typically, gravity systems are used in cross-flow cooling towers, and spray systems are used in counter-flow cooling towers. In a spray system, liquid of high temperature is distributed through the cooling tower using a series of spray nozzles mounted on distribution pipes. The spray nozzles are arranged to evenly distribute the liquid over the top of media fill, designed to provide an increased surface area to facilitate cooling of the liquid. Once the now-cooled liquid travels through the media fill, it is collected at the bottom of the tower in a cold liquid basin. In a gravity system, liquid of high temperature is fed into a hot liquid basin disposed above the media fill. The liquid then travels through holes or openings in the bottom of the hot liquid basin to the media fill to facilitate cooling of the liquid. Similar to the spray system, liquid that travels through the fill is collected at the bottom of the tower in a cold liquid basin. To prevent further loss of liquid and increase the efficiency of a cooling tower, drift eliminators are often implemented to capture large water droplets above the water distribution system which is mixed with the heated air exhausted.

Current cooling tower assembly is often labor intensive in their assembly at the job site, especially in the case of large, field erected cooling towers. During replacement of an entire cooling tower or an individual cell in a multi-cell cooling tower, the prior art typically makes use of, and incorporates, the vertical columns which form the original general structure of the cooling tower. Cooling towers and related cells are often constructed in fields where more than a single cooling tower is utilized. In a multi-cell cooling tower, the cold liquid basin (which is typically 10-feet deep) is a shared basin amongst all the individual cooling tower cells. The current industry accepted field construction methodology is to replace either one cell at a time or replace all of the cells in the cooling tower simultaneously. Thus, one must disassemble and breakdown the old tower and related cells prior to the building of the new tower and related cells. It is also common industry practice to shut down the cells in a multi-cell cooling tower and reconstruct a cell member-by-member all while the remaining other cells are out of operation. This is a result of the disassembly of operational equipment driving the cells. Thus, it is desirable to assemble a replacement cooling tower in-situ, i.e., while other cooling towers within the field are operational, so that the construction of the new cooling tower does not stop the usage of the other cooling towers within the cooling tower field.

The construction of a cooling tower is a manual process and since the cost of labor for the replacement of a cooling tower is so great, it is also desirable to prefabricate cooling tower components at the factory, but conventional crossflow and counterflow designs for cooling towers oftentimes necessitate their assembly at a job site. For example, the size of the various tower component assemblies may limit their ability to be manufactured at the factory and transported to site. On the other hand, factory assembled cooling towers can be costly due to shipping inefficiencies, as well as difficulties in such areas as the sealing of the modular joints.

Therefore, it is desirable to have a cooling tower that is assembled in modules using components that can be prefabricated and manufactured in a factory and transported to a job site for final assembly. In particular, it is desirable to have a cooling tower that can be assembled with modular components in a factory, so that the cooling tower may be constructed in-situ without the removal, destruction, or temporary shutdown of adjacent remaining cells, which make up the complete and entire cooling tower field. It is further desirable to provide a method of installing a modular cooling tower with greater efficiency and safety than the methods of those utilized in the prior art. It is further desirable to provide a customized, modular assembly model which may be retrofitted into preexisting cooling tower fields, thereby removing the need to change existing mechanical components in the cooling tower field, and instead utilize the preexisting inlet piping, pumps, and related pump head pressures of the original structure. Another object of the present invention is to keep an existing cold-water basin intact and functioning in the same mechanical manner as it was intended to do in an existing cooling tower field.

SUMMARY OF THE INVENTION

Bearing in mind the problems and deficiencies of the prior art, it is therefore an object of the present invention to provide a method of replacing a preexisting cooling tower cell without stopping operation of adjacent cooling tower cells that make up the overall cooling tower field.

It is another object of the present invention to provide a method of replacing a cooling tower that may be assembled in a faster manner than the prior art, further minimizing the downtime of the cooling tower cell during replacement.

A further object of the invention is to provide an improved method of installing a cooling tower framework and related modules within the field.

It is yet another object of the present invention to provide a method of installing a modular cooling tower that may utilize preexisting mechanical equipment such as the fan stack, fan assembly and hub, torque tube, gear box, motor, and other related common cooling tower mechanical equipment.

A further object of the invention is to provide a modular design methodology which may modularize any existing cooling tower cell of any dimension, which reduces the effort required for all project phases: concept, design, engineering, fabrication, transportation, & erection.

It is another object of the present invention to provide improved thermal performance, site safety, consistent and repeatable product quality, and reduced field construction time, and manpower requirements.

A further object of the present invention is to provide a quick, secure, and structurally sound means to construct a cooling tower using modular construction pieces.

Still other objects and advantages of the invention will in part be obvious and will in part be apparent from the specification.

The above and other objects, which will be apparent to those skilled in the art, are achieved in the present invention which is directed to a method of assembling in-situ a cooling tower within a cooling field, comprising, (a) removing a single cooling tower cell in a cooling tower field having a plurality of cooling tower cells, including removing vertical columns which form an original structure of said single cooling tower cell, exposing said cooling tower cell basin footing; (b) providing a lifting device with a spreader platform comprising carrier beams and lifting cables secured to said carrier beams at one end and said lifting device at an opposite end, wherein the spreader platform is capable of supporting, balancing and lifting objects below the spreader platform by lift members to be attached to the spreader platform via securing members; (c) providing a plurality of foundation beams each comprising an elongated member having a longitudinal axis, a first end, a second end opposite said first end, a top surface, and a bottom surface opposite said top surface, said top surface and said bottom surface extending along said longitudinal axis between said first end and said second end, said top surface including securing members extending from said top surface in a direction perpendicular to said longitudinal axis; (d) attaching said securing members to said lift members, thereby securing at least one of said plurality of foundation beams to said lift members; (e) lifting the spreader platform with the lift member to thereby lift said spreader platform and the at least one of said plurality of foundation beams; (f) while lifted, moving the spreader platform and the at least one of said plurality of foundation beams to a site location above said exposed basin footing; (g) lowering the at least one of said plurality of foundation beams to said site location; and (h) detaching said lift members from said securing members. The spreader platform may further comprise lift beams transverse to said carrier beams.

The method may further include the steps of (i) providing a first framework structure of a modular cooling tower cell, comprising a rectangular framework structure and vertical members each having a top and a bottom end and an axis in the vertical direction, fitting lug projections extending from said vertical member top end along said vertical axis, and receiving lugs on said bottom end of said vertical members, wherein said fitting lug projections are sized to be fitted with complementary receiving lugs of a second framework structure to secure said first framework structure to said second framework structure, and wherein said receiving lugs are sized to be fitted with said securing members of the at least one of said plurality of foundation beams to secure said rectangular framework structure to the at least one of said plurality of foundation beams; (j) inserting said fitting lug projections within said lift members, thereby securing said first framework structure to said lift members; (k) lifting the spreader platform with the lift member to thereby lift said spreader platform and said first framework structure; (l) while lifted, moving the spreader platform and the first framework to a position above the at least one of said plurality of foundation beams; (m) lowering said first framework structure onto the at least one of said plurality of foundation beams, and subsequently aligning said securing members with said receiving lugs of said first framework structure; (n) inserting said securing members within said receiving lugs of said first framework, thereby securing said first framework to said at least one foundation beam; and (o) detaching said lift members from said fitting lug projections. In addition, the method may further include (p) providing a second framework structure of the modular cooling tower cell, said second framework structure comprising a rectangular framework of the cooling tower cell, having a top end, a bottom end, and second framework vertical members each having a top end and a bottom end and an axis in the vertical direction, lifting lug projections extending from said second framework structure vertical member top end along said vertical axis, and receiving lugs on said bottom end of said second framework structure vertical member; (q) inserting said lifting lug projections within said lift members, thereby securing said second framework structure to said lift members; (r) lifting the spreader platform with the lift member to thereby lift said spreader platform and said second framework structure; (s) while lifted, moving the spreader platform and the second framework structure to a position above said first framework structure; (t) lowering said second framework onto said first framework structure, and subsequently aligning said fitting lug projections with said receiving lugs of said second framework structure; (u) inserting said fitting lug projections within said receiving lugs of said second framework structure, thereby securing said second framework structure to said first framework structure; and (v) detaching said lift members from said lifting lug projections. The lift members may be connected to the spreader platform by a braided metal cable. The basin footing may have a length and a width and step (g) may include securing the at least one of said plurality of foundation beams across the width of said basin footing such that the at least one of said plurality of foundation beams is elevated above a water level on said basin footing. The method may be completed while at least one of said plurality of cooling tower cells in said cooling tower field remain operational.

The present invention also provides a method of designing a modular cooling tower cell, comprising providing a plurality of vertical and horizontal members having dimensional measurements and a predetermined bolt hole pattern consistent along a length of each of said plurality of vertical and horizontal members, said predetermined bolt hole pattern comprising a plurality of connection points; collecting at a first location a data set from a preexisting cooling tower cell, said data set including at least, basin size data, cell size data, fill elevations, header pipe elevations, and deck elevations; using said data set to generate a build specification for a modular cooling tower cell to replace said preexisting cooling tower cell, said modular cooling tower cell comprising a plurality of modules; calculating a custom cut list for vertical and horizontal members which form the basis of said plurality of modules; adjusting said dimensional measurements of said plurality of vertical and horizontal members without affecting said plurality of connection points; using a manufacturing device to fabricate said vertical and horizontal members according to said custom cut list, each of said vertical and horizontal members including the plurality of connection points; constructing at a second location the plurality of modules using said build specification such that the vertical and horizontal members are connected using said plurality of connection points to form said module, each of said plurality of modules comprising a matrix having a height, a length, and a width based on the data set from said preexisting cooling tower cell; and moving said plurality of modules from said second location to said first location where said plurality of modules may be installed; wherein said build specification allows the modular cooling tower cell to utilize mechanicals of said preexisting cooling tower cell after installation of said plurality of modules. Each of said plurality of modules may further include a plurality of brace members such that said plurality of modules provides a truss-like structure in said modular cooling tower cell. The modular cooling tower cell may further comprise a plurality of foundation beams, wherein said manufacturing device fabricates said plurality of foundation beams, wherein said foundation beams are constructed at said second location, and where said plurality of foundation beams are moved from said second location to said first location for installation, such that said modular cooling tower cell may utilize mechanicals of said preexisting cooling tower cell after installation of said plurality of modules and said plurality of foundation beams.

The present invention further provides a lift mechanism for use in assembling a modular cooling tower comprising a spreader platform comprising carrier beams, lift beams transverse to said carrier beams, and lifting cable secured to said carrier beams at one end and attachable to a lifting device at a second end; said lift beams including a securing member, said securing member attached to said lift beams at one end and attached to a lift member at a second end; and said lift member capable of mating with a structure lug of a cooling tower structure such that said spreader platform may raise, lower, move or any combination thereof said cooling tower structure from an uninstalled position to an installed position. The lifting lugs may further include projections for fastening the structure lug thereto. The lift beams may further comprise a coupling assembly having a plurality of apertures, to change a position said securing member is secured to said lift beams such that twisting and/or swaying of the spreader platform, said cooling tower structure, or both is prevented.

The present invention further provides a foundation beam for establishing a base platform for a replacement modular cooling tower cell, comprising an elongated member having a longitudinal axis, a first end, a second end opposite said first end, a top surface, and a bottom surface opposite said top surface, said top surface and said bottom surface extending along said longitudinal axis between said first end and said second end; a plurality of securing lugs extending in a direction perpendicular to said top surface; and an anchor footing on each of said first end and said end, said anchor footing including a flange extending from said bottom surface; wherein said elongated member may be placed across a width of a cooling tower basin footing such that said flange portion may retain an edge of said basin footing thereon to secure said elongated member to said cooling tower basin foundation; and wherein each of said plurality of securing lugs are sized to be received by a complementary receiving lug of similar dimensions during installation of said replacement modular cooling tower cell. The securing lugs may be received within lifting lugs and secured thereto such that a lifting device attached to said lifting lugs may raise, lower, move, or any combination thereof said foundation beam from an uninstalled position to an installed position. The plurality of securing lugs may further include a shim plate, said shim plate adjacent to said top surface and moveable in a first direction and/or second direction, said first direction parallel with said longitudinal axis and said second direction perpendicular to said longitudinal axis.

The present invention also provides an apparatus for securing construction material to be lifted, comprising a housing having a first end, a second end, and a body therebetween extending along a longitudinal axis; a top end secured to said first end, said top end including a flange extending from said first end along said longitudinal axis; said flange including a projection for securing a lifting member thereto; said housing second end configured to receive a lug from a piece of construction material therein; and said housing body including at least one opening to receive a fastener for securing said lug to said housing body, wherein said apparatus and said construction material can be lifted and moved by said lift member once secured thereto; wherein said fastener is removable after said construction material is lifted and moved from an uninstalled position to an installed position.

The present invention further provides a structure forming a portion of a modular cooling tower, comprising a rectangular framework of the structure including vertical members each having a top end and a bottom end and an axis in the vertical direction; a fitting lug projection extending from at least one of said vertical members top end along said vertical axis; and a receiving lug on at least one of said bottom end of said vertical members; wherein said fitting lug projection is sized to be fitted with a complementary receiving lug of a second structure to secure said rectangular framework to said second structure, and wherein said receiving lug is sized to be fitted with a complementary fitting lug of a third structure to secure said rectangular framework to said second structure. The fitting lugs may be received within a lift member on a lifting device and secured thereto such that said lifting device may raise, lower, move or any combination thereof said structure from an uninstalled position to an installed position. The rectangular framework of the structure may further include horizontal members secured to said vertical members to form the rectangular framework, said horizontal members and said vertical members further including a plurality of repeating bolt hole patterns comprising a plurality of connection points such that one or more dimensions of said rectangular framework may be constructed. The fitting lug projection may optionally include an alignment block.

The present invention also provides a structure forming the lower portion of a single cooling tower cell, comprising a plurality of foundation beams each comprising an elongated member having a longitudinal axis, a first end, a second end opposite said first end, a top surface, and a bottom surface opposite said top surface, said top surface and said bottom surface extending along said longitudinal axis between said first end and said second end, said top surface including securing members extending in a direction perpendicular to said top surface, and an anchor footing on each of said first end and said second end, said anchor footing including a flange extending from said bottom surface; and a first framework structure of the single cooling tower cell, comprising a rectangular framework structure including vertical members each having a top and a bottom end and an axis in a vertical direction, and receiving members on said bottom end of said vertical members, wherein said receiving members are sized to be fitted with said securing members of at least one of said plurality of foundation beams to secure said first framework structure to the at least one of said plurality of foundation beams; wherein said plurality of foundation beams may be placed across a width of a cooling tower basin footing such that said flange portion may retain an edge of said basin footing thereon to secure said plurality of foundation beams to said cooling tower basin. The first framework structure may further include fitting member projections extending from said vertical member top end along said vertical axis, wherein said fitting lug projections are sized to be fitted with complementary receiving members of a second framework structure to secure said first framework structure to said second framework structure. The rectangular framework of the structure further includes horizontal members secured to said vertical members to form the rectangular framework, said horizontal members and said vertical members further including a plurality of repeating bolt hole patterns comprising a plurality of connection points such that one or more dimensions of said rectangular framework may be constructed.

The present invention further provides a method of installing a subassembly of a modular cooling tower cell within a cooling tower field in-situ, comprising (a) providing at a first location a first framework structure of the modular cooling tower cell, comprising a rectangular framework structure including vertical members each having a top and a bottom end and an axis in the vertical direction, fitting lug projections extending from said vertical member top end along said vertical axis, and receiving lugs on said bottom end of said vertical members, wherein said fitting lug projections are sized to be fitted with complementary receiving lugs of a second structure to secure said first framework structure to said second framework structure, and wherein said receiving lugs are sized to be fitted with complementary receiving lugs of a third structure to secure said first framework structure to said third structure; (b) installing, at said first location, media fill, distribution piping, or both within said first framework structure; (c) moving said first framework structure to a second location and installing said first framework structure, such that said first framework structure forms said subassembly of said modular cooling tower cell; and (d) connecting said distribution piping to an existing inlet piping and pumps within said cooling tower field.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 28A is a magnified view of an installed foundation beam of FIG. 25;

FIG. 28B is a top plan view of the magnified view of the installed foundation beam of FIG. 28A;

FIG. 28C is a side cross-sectional view of the installed foundation beam of FIG. 28B, along lines A-A;

FIG. 29 is a perspective view of portion of an embodiment of a structural framework of the modular cooling tower cell of the present invention;

FIG. 30A is a perspective view of a portion of an embodiment of the foundation beam of the modular cooling tower cell of the present invention;

FIG. 30B is a perspective view of a portion of an embodiment of the foundation beam of the modular cooling tower cell of the present invention;

DESCRIPTION OF THE EMBODIMENT(S)

Figure 1:
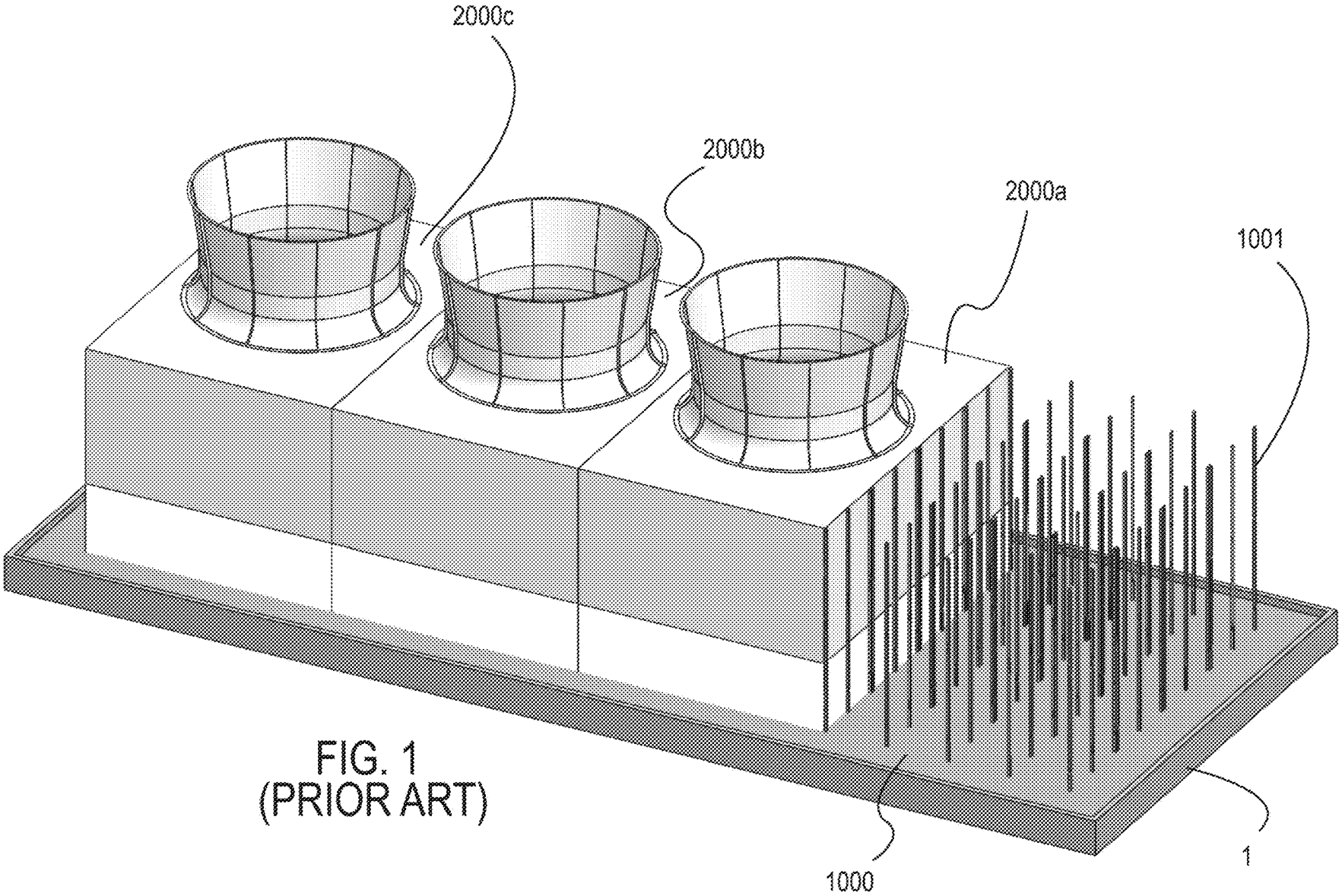
FIG. 1 (PRIOR ART)
FIG. 1 is a perspective view of a prior art method of installing a cooling tower.

In describing the embodiment of the present invention, reference will be made herein to FIGS. 1-32 of the drawings in which like numerals refer to like features of the invention.

The present invention incorporates a method of manufacture and installation for one or more cooling tower cells within a cooling tower field. The effectiveness and efficiency of a cooling tower field is often dependent upon the integrity of the structural frame members and mechanicals within one or more cells. Prior art methods of cooling tower replacement require the entire replacement of a cooling tower field 2000*a*, 2000*b*, 2000*c*, since the use of preexisting distributions systems cannot be reused upon replacement of one or more cells within a field. The present invention is not so restricted and may utilize mechanicals of an original system including inlet piping and pumps, fan stack, fan assembly and hub, torque tube, gear box, motor and other related mechanical equipment. This not only reduces installation costs and materials but ensures the continued reliability of the system as a whole.

In contrast to prior art replacement of cooling towers, which utilize existing vertical member-construction foundation columns 1001 for replacement of one or more cells (see FIG. 1), the modular cooling towers of the present invention remove the entire preexisting lower column framework 1001 which is bolted to the existing concrete basin floor, leaving only the original basin footing 1. After removal of the lower column framework, the modular cooling tower of the present invention employs heavy duty foundation beams 5 in-situ across the water-filled basin 1000, the method of which will be discussed in detail below. After spanning the basin foundation 1 with the foundation beams 5, a series of custom modules are utilized to erect layers of the cooling tower cell to be constructed and installed. In one or more embodiments, these modules may include as little as two layers, although the number of module layers are for exemplary purposes only.

With reference to the FIGS. 2-3, and 10-14, the method and structure of the present invention is described with respect to a preferred embodiment of a modular cooling tower, as an example, without limitation, of a field-erected, relocatable structure to be manufactured and constructed at a manufacture location and then moved to a site location, where the final assembly and construction is completed on-site. Advantageous to the present invention, the manufacture/construction of the modules of the cooling tower cell can be ongoing while the site location is being prepared or while a previous cooling tower at the site location is being disassembled and removed, further limiting the construction time needed. The method includes the construction of a multi-portion structure where a portion is constructed at the manufacture location and then moved to the site location, which would then be field-erected directly at the site location. Thus, the modular construction allows for construction of critical components of the cooling tower at different locations, one such location being at the site of construction, and the other(s) at off-site facilities.

Figure 22A:
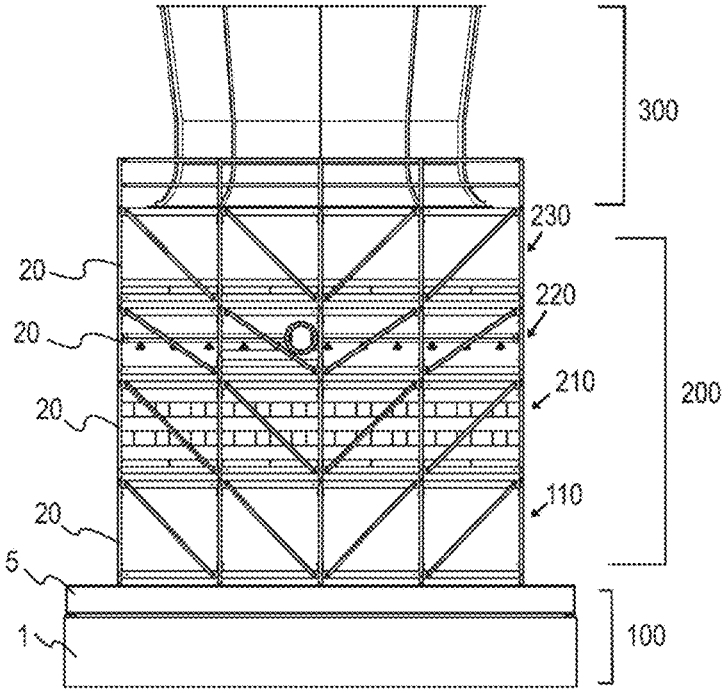
FIG. 22A is a side plan view along the width of an embodiment of the modular cooling tower cell of the present invention.
Figure 22B:
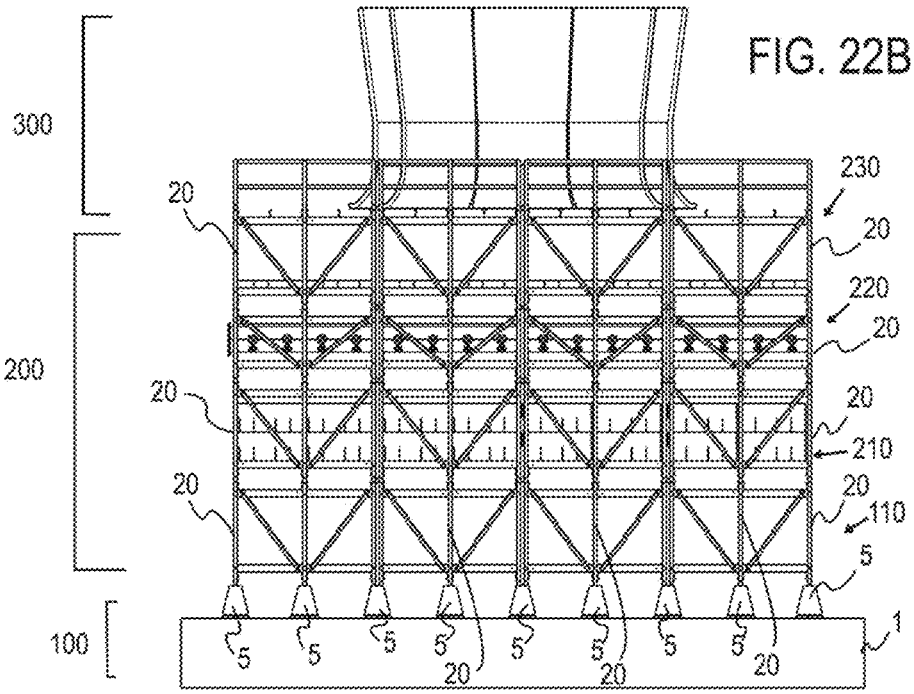
FIG. 22B is a side plan view along the length of an embodiment of the modular cooling tower cell of the present invention.
Figure 23:
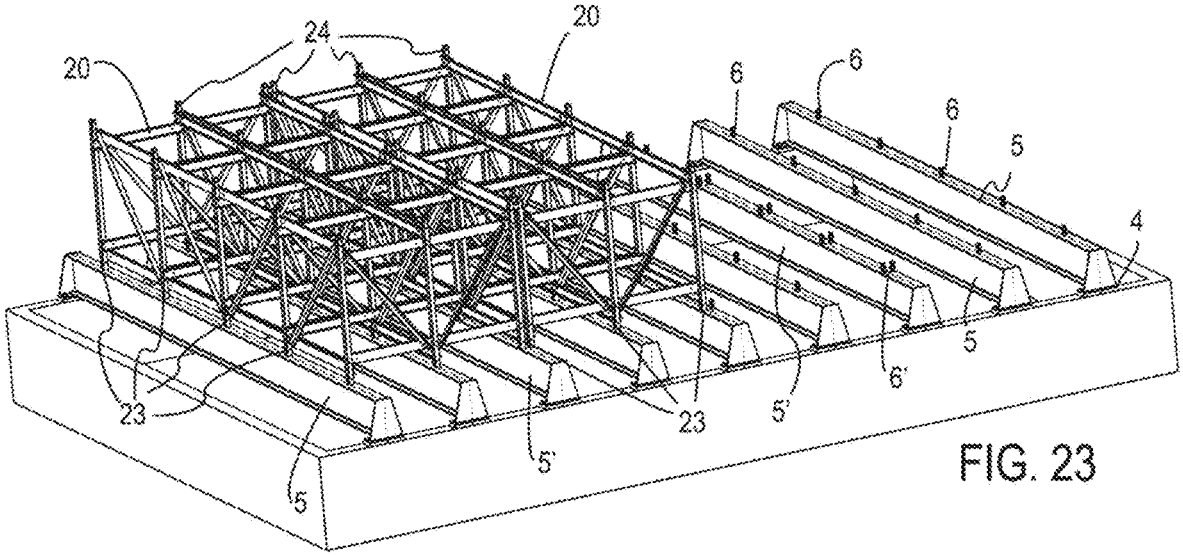
FIG. 23 is a perspective view of an embodiment of the modular cooling tower cell of the present invention depicting a series of structural frameworks assembled on foundation beams.

Turning now to FIGS. 22A and 22B, an exemplary modular cooling tower cell of the present invention is depicted having three sections: a basin section 100, a structural framework section 200, and a stack section 300. The basin section 100 includes a liquid basin foundation 1 which is the original liquid basin of the cooling tower cell which was deconstructed, and foundation beams 5 spanning the foundation 1 and providing a structural base for the remainder of the modular cooling tower cell.

The structural framework section 200 of FIGS. 22A and 22B is formed of multiple layers of framework modules, including an airflow module layer 110 comprised of one or more empty modules 20 of the present invention which sit atop foundation beams 5 and are described in further detail below, a media fill module layer 210 adjacent airflow module layer 110, distribution module layer 220 between fill media module layer 210 and the topmost drift eliminator module layer 230. Atop and adjacent structural framework section 200 is stack section 300. Unlike modular cooling tower cells of the prior art, the cell of the present invention is composed of layers formed from a plurality of laterally adjacent interlocking and dynamic modules 20 which are capable of varying construction dimensions allowing for use of the existing stack section of the cell being replaced, including the fan stack, fan assembly and hub, torque tube, gear box, motor, and other related mechanical equipment forming stack section 300. While the preferred embodiment depicts a modular cooling tower cell having four module layers, other configurations are not meant to be precluded. The cell may include more than a single empty module layer to facilitate air-flow throughout the cell, and similarly non-vertical arrangements and orientations for the cell mechanicals may be utilized to accommodate cooling tower cells of crossflow or other designs.

The embodiments of the cooling tower cell of the present invention allow for manufacture and assembly of cell modules before shipping to a construction site for installation. Unlike the methods of conventional cooling tower cell assembly, the modules of the present invention may be fabricated using specific, pre-determined dimensions which may vary on a project-by-project basis to allow for the custom cell design which reproduces the former cell's dimensions to remove the need to completely replace water inlet distribution systems and related pumps of the former cell. Thus, the design of the present invention may be adapted to any size or shape to accommodate replacement of one or more cooling tower cells of varying basin sizes, cell structure, and key elevations within the cooling tower cell which accommodate for structural components, such as fill, header pipe, or decking. These variations may be performed prior to modules arriving to site. The salient features of the cooling tower cell manufacture of the present invention allow accommodation of existing cell mechanicals within the replaced cell reducing labor expenses and material requirements.

Figure 16A:
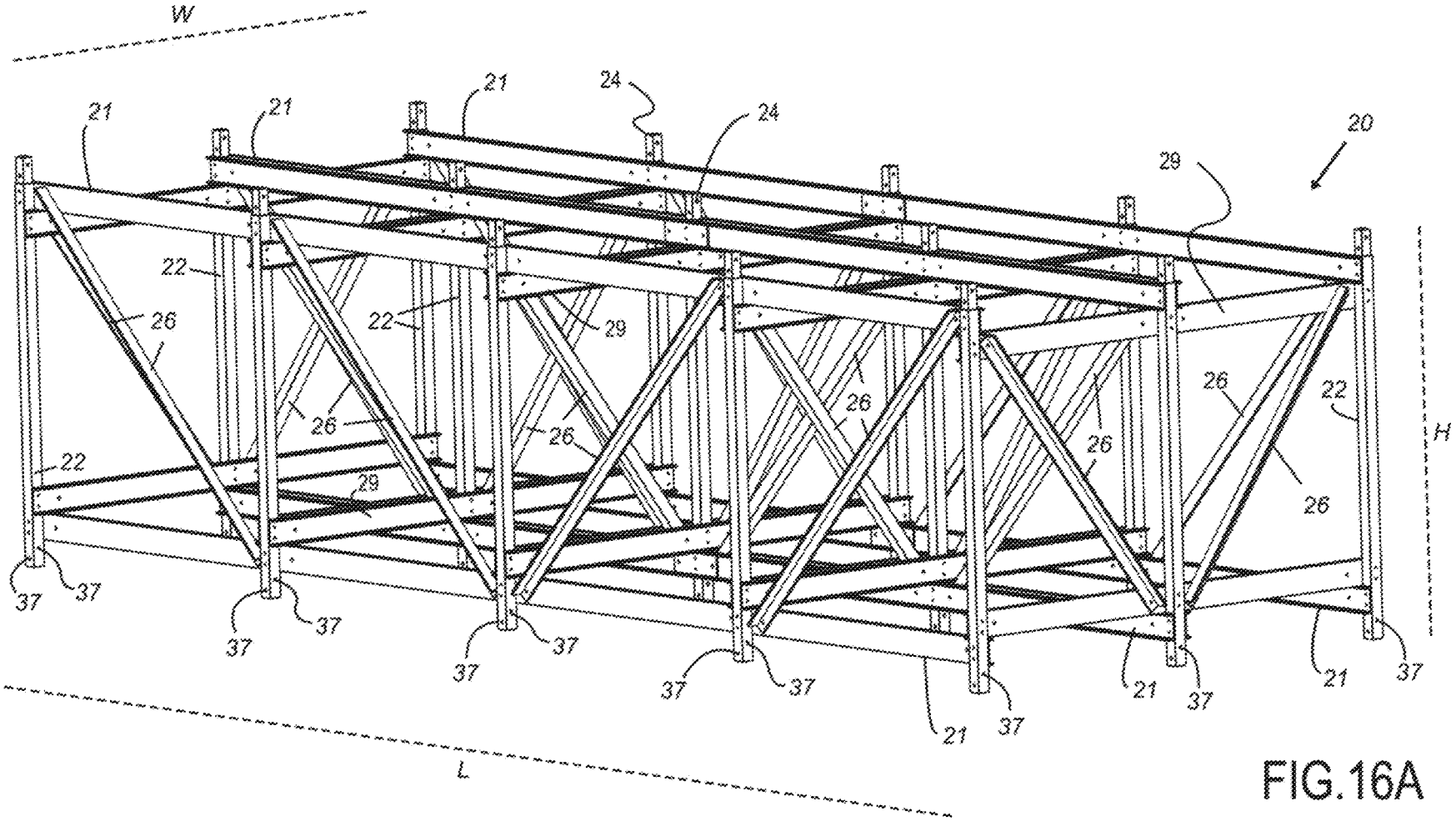
FIGS. 16A and 16B are perspective views along the width of a portion of the structural framework of a module forming the modular cooling tower of the present invention.
Figure 16B:
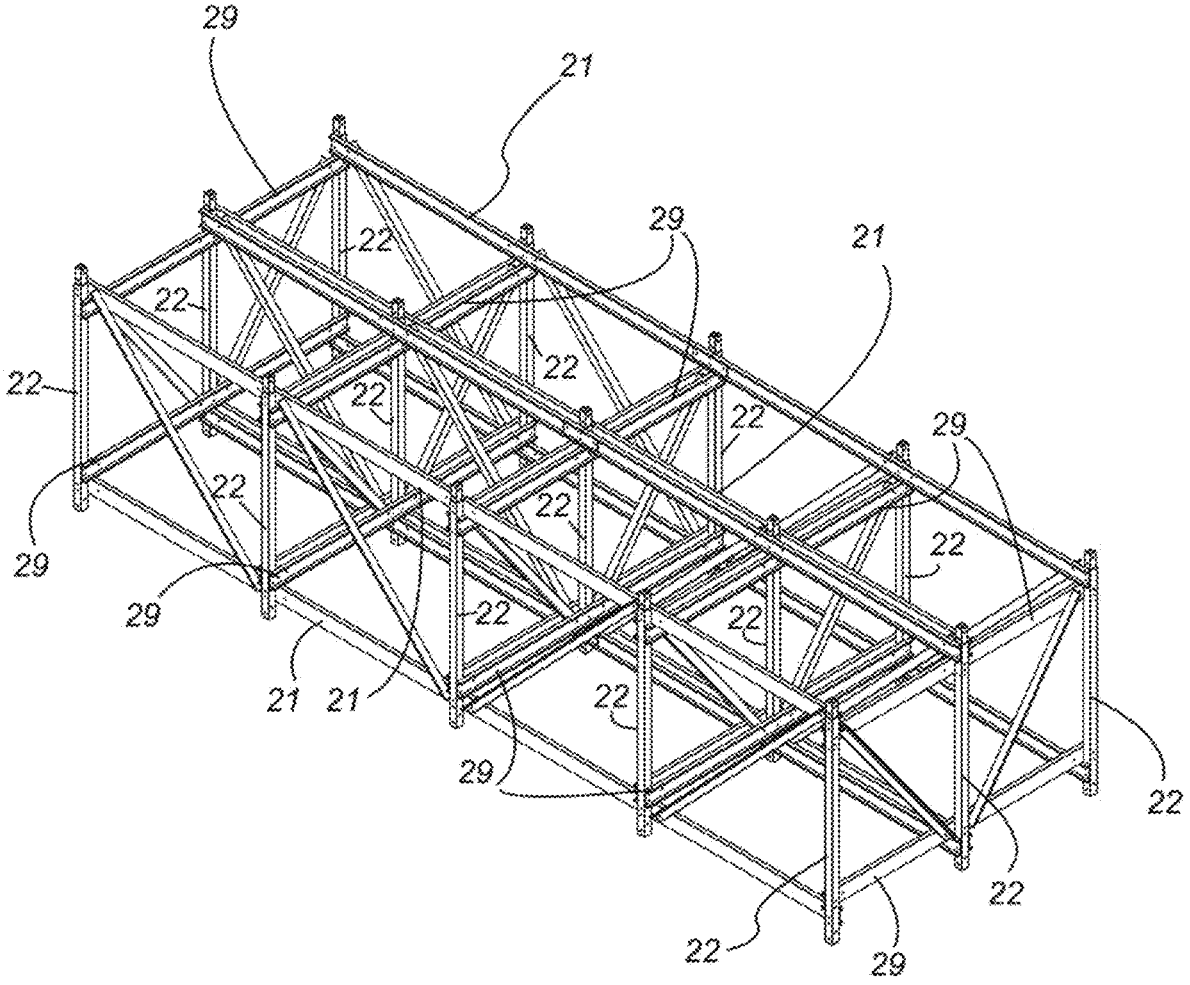

Turning now to FIG. 16A, an exemplary constructed module 20 is shown. Each module consists of a framework of vertical and horizontal members which form a matrix or grid-like construction of the module. The exemplary module framework depicted in FIG. 16A includes three (3) vertical members 22 spaced uniformly across matrix width W and five (5) vertical members 22 spaced uniformly across matrix length L, forming a 3×5 matrix module framework 20. Vertical members 22 are typically made of a tubular fiberglass-reinforced polymer, hot-dipped galvanized steel, stainless steel or the like, where the tubes preferably have a square cross-section, though tubes of other shapes and material are not to be precluded. It should be further understood, a salient feature of the present invention is to provide module matrices which may be expanded or contracted to any size necessary to meet design requirements, and therefore may vary in matrix patterns or dimensions including length, width, and height. The vertical members 22 are releasably attachable to other modules or structures forming the modular cooling tower cell via male and female connectors located at the ends of each member. Preferably, the extended vertical members 22 of the module 20 will have a mating connector 24 at each end to mate with a corresponding connector 23 of either a vertically adjacent module framework structure and/or a spreader platform as discussed further below. As depicted in the figures, female lugs 23 and male lugs 24 are the preferred embodiments for adjoining the heavy structural components.

Figure 15A:
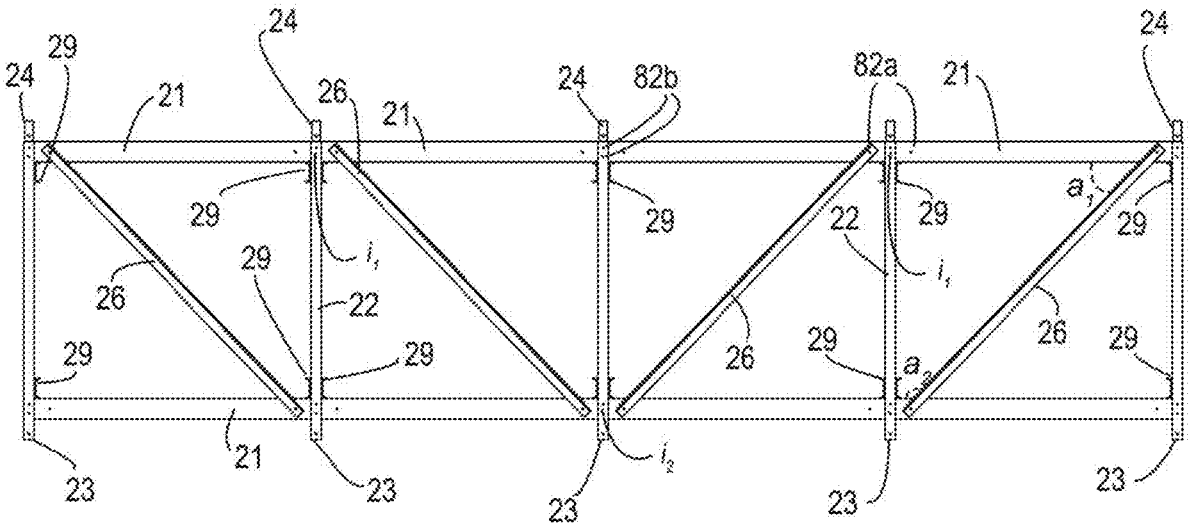
FIG. 15A is a side plan view along the length of a structural framework of a module portion.
Figure 15B:
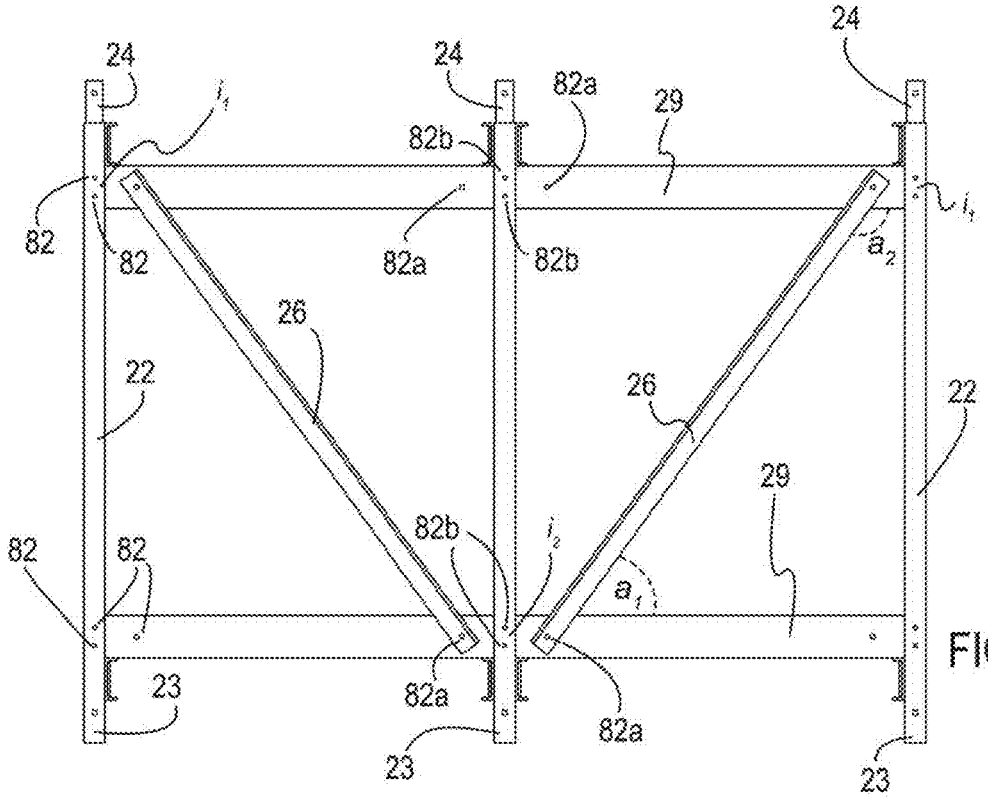
FIG. 15B is a side plan view along the width of the structural framework of FIG. 15A.

Enclosing the module 20 matrix along the length L are a plurality of longitudinal members 21 which may be secured to the vertical member 22 along the height H of the vertical member via fasteners, welding, or any other connection means known in the art. Connecting the module 20 framework along the matrix width are a plurality of transverse members 29, and may be similarly secured to via fasteners, welding, or other means to the vertical members 22, longitudinal members 21, or both. To ensure the stability of the module framework, the present invention utilizes brace members 26 spanning between intersections within the matrix created by one or more horizontal members, i.e., longitudinal members 21 or transverse members 29, and vertical members 22 of the module framework 20, an example of which is depicted in FIGS. 15A and 15B, showing brace members 26 spanning adjacent and between two intersections $i_1$, $i_2$ within the module framework 20. The brace members 26 of the present invention may be secured adjacent any intersection of the matrix interior or exterior to provide necessary rigidity to the module framework which would allow for the module 20 to be properly shipped from a manufacturing or first location to a construction site or second location where it can be installed to form a cooling tower cell. The design of the module framework structures of the present invention allows for brace members which need only span a single column bay to provide sufficient rigidity to the cooling tower cell, unlike conventional framework structures of the prior art which span multiple column bays of the structure.

Figure 26A:
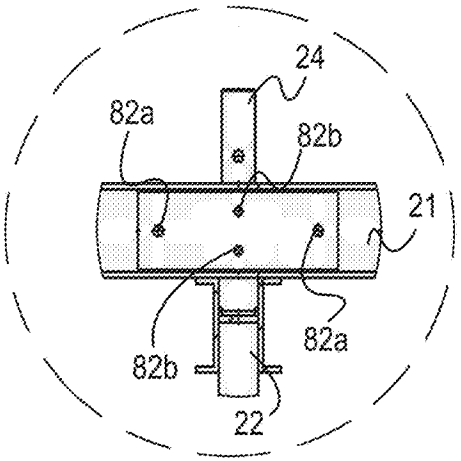
FIGS. 26 and 26A are a side plan view, and a magnified view, respectively of a length of a structural framework of the modular cooling tower cell of the present invention.
Figure 26:
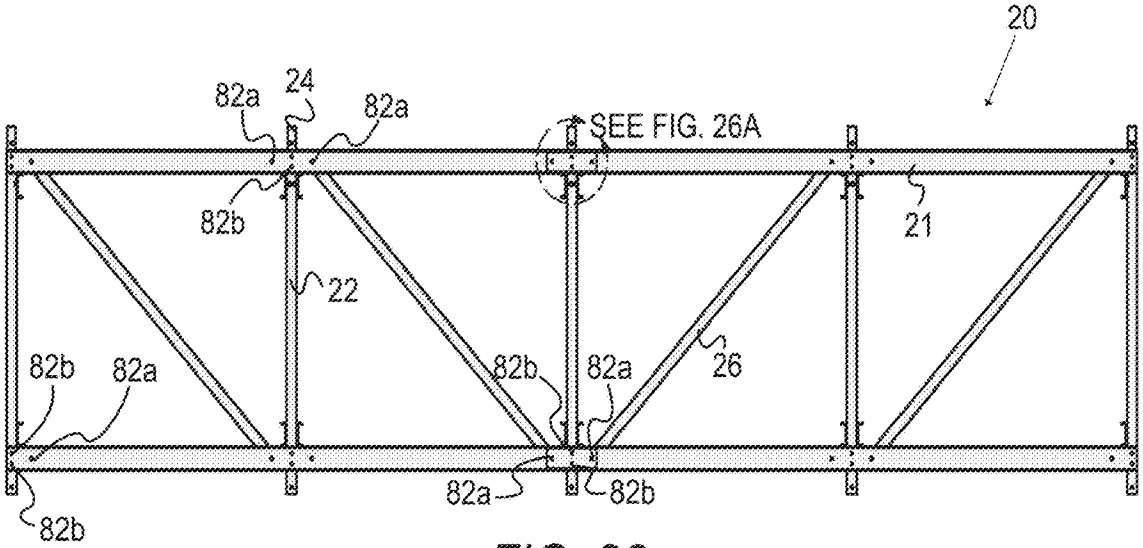

As seen in FIG. 26, a detailed view of a section of module 20 is shown incorporating the bracing structure within a module structure. As depicted, any of the horizontal or vertical members may include a plurality of through holes spanning along the length of the member in repeated patterns. Though not intended to be limiting, the exemplary through hole configuration of FIG. 26A incorporates four openings allowing for a cross pattern, having two holes 82*a* along the length of the horizontal member 22, and two holes 82*b* spanning the width of the horizontal member located at the midpoint of holes 82*a*, or at an approximate location thereto. In some embodiments, the through hole construction may be incorporated throughout vertical members 22 or even transverse members 29. During construction of the module 20, the repeating pattern of the through holes 82 allows implementation of the modular nature of the present invention's module framework structure, allowing sizing variations to the dimensions of the horizontal and vertical members while facilitating a plurality of connection points. While the horizontal and vertical members may be interlocked to one another in one or more of the through holes 82, not all of through holes 82 will be utilized during the construction of the module 20. Similarly, a portion of the cross pattern may be utilized, as shown, at the outermost vertical members of module 20, where only three through holes are utilized. Thus, the construction of the module 20 may be customizable, resizing according to the in-situ dimensions of the cooling tower cell that is to be replaced. In this manner, consistent and flexible hole patterns 82 throughout the entire module structure allows for efficient automation and robotic fabrication, and the modular design philosophy of the present invention may modularize any existing cooling tower cell of any dimension within the physical limits of the structural framework members. This is advantageous to the construction of the cooling tower cell, allowing the modular cooling tower of the present invention to replicate existing dimensions of a single cooling tower cell which is to be replaced in a cooling tower cell bank, thereby allowing utilization of the replaced cells inlet piping and pumps to achieve related pump head pressures of the original structure. By incorporating the hole pattern across the modules which compose the entire cell, the manufacturing process is greatly simplified, requiring minimal tools. Furthermore, the hole pattern 82 increases symmetry of the modules 20, which reduces fabrication complexity because the vertical or horizontal members forming the modules 20 may work in any orientation. Thus, the modular cooling towers of the present invention further utilize topology and connection design in tandem with a flexible design and engineering system that is capable of expanding and contracting to any project specific structural and mechanical dimensions. While the module 20 topology forming a 3×5×2 (W×L×H) vertical and horizontal framework matrix is just one example arrangement, these are for exemplary purposes only, and other module topologies are not meant to be precluded. Any number of framework arrangements are possible, including: 2×3×2, 2×5×2, 2×7×2, 2×3×3, etc. Preferably, any topology within the arrangements of (2 or 3) W×(2, 3, 5, or 7) L×(2 or 3) H, thereby forming 16 different combinations, is possible with the hole pattern 82. Thus, the combination of any of these 16 modules topologies, along with hole pattern 82 provide the salient features of the present invention to accomplish the design, manufacture, and installation capable to form any custom cooling tower dimensions.

Unlike the brace configuration of prior art modules, particularly with respect to those of U.S. Pat. No. 9,739,069 issued to Jiang et al. on Aug. 22, 2017, titled, "METHOD OF ASSEMBLING COOLING TOWERS", the bracing configuration of the modules of the present invention do not form triangular structures, rather trapezium structures which are preferentially right trapezoids formed from the connection of the bracing members 26 spanning adjacent intersections $i_1$, $i_2$ constructed from the vertical and horizontal members forming the module. Generally, the vertical members 21 of the module form the altitude portion of the trapezium, with brace 26 forming the leg and horizontal member 21, 29 forming the longest base portion. The length of the horizontal member between the vertical member 22 and one through hole 82*a* form the second, shorter base of the trapezium connection of the module 20. The trapezium structure of the present invention creates a truss-like structure throughout the modules 20 which make up the final cooling tower cell, and provide the entire cooling tower cell with an integral structure that is specifically designed to withstand wind and seismic loads to the final cell after complete installation. It should be understood by a person of skill in the art that the interior angles $a_1$, $a_2$ forming the trapezium may vary depending on the dimensions of the vertical and horizontal members as well as the brace members, as an object of the present invention is to provide dynamic, adjustable modules which may be designed to replace one or more cooling tower cells within a field.

Figure 17:
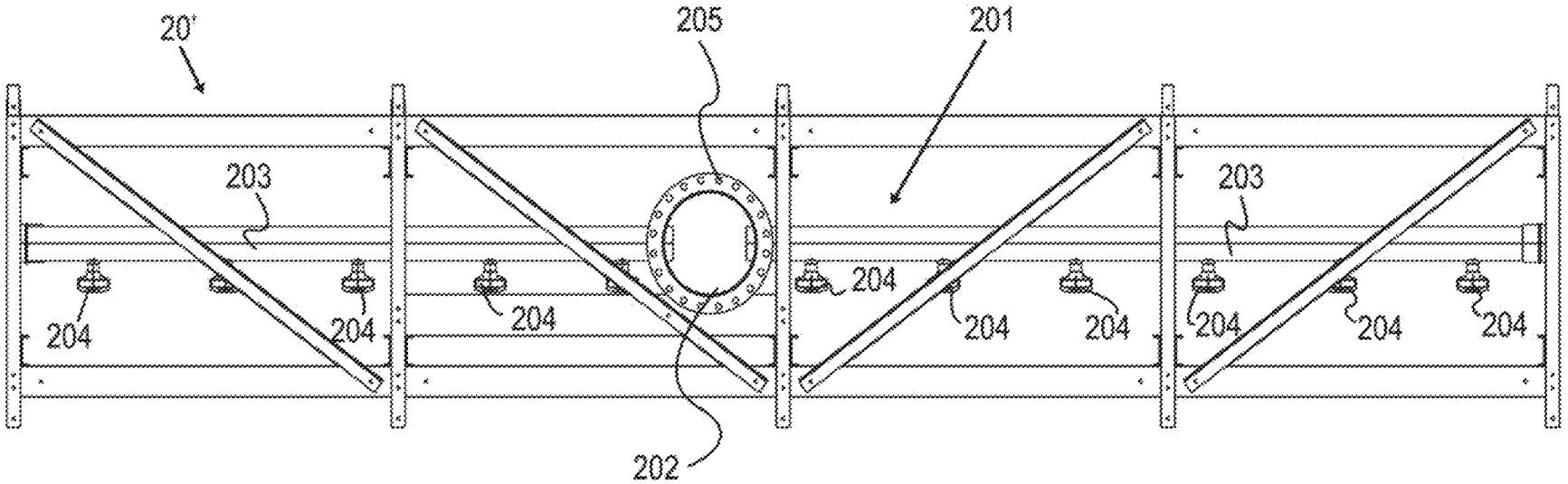
FIG. 17 is a side plan view along the length of an embodiment of the structural framework of a module forming the modular cooling tower of the present invention.
Figure 18:
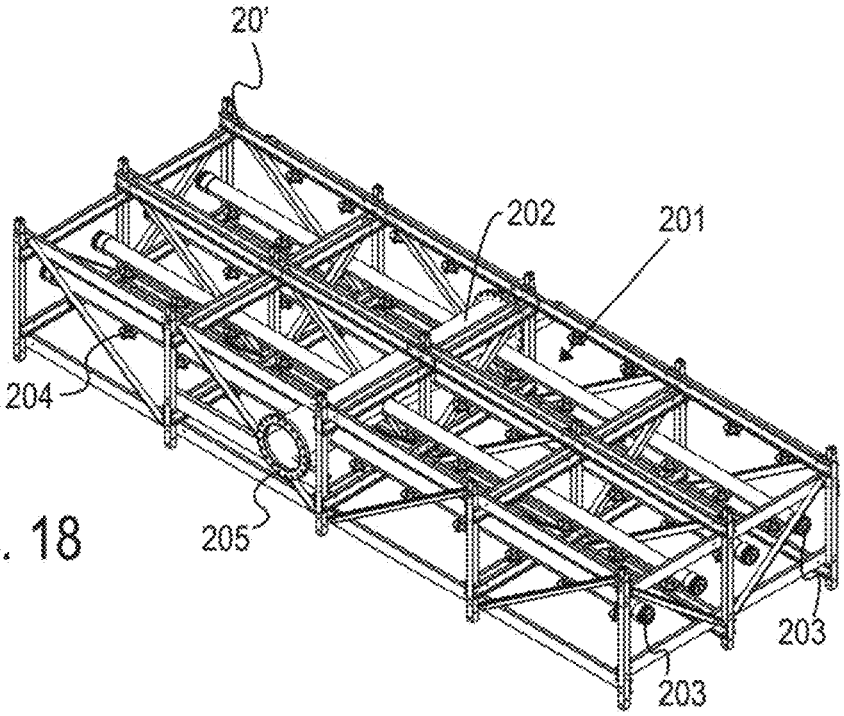
FIG. 18 is a perspective view of the structural framework of FIG. 17.
Figure 19:
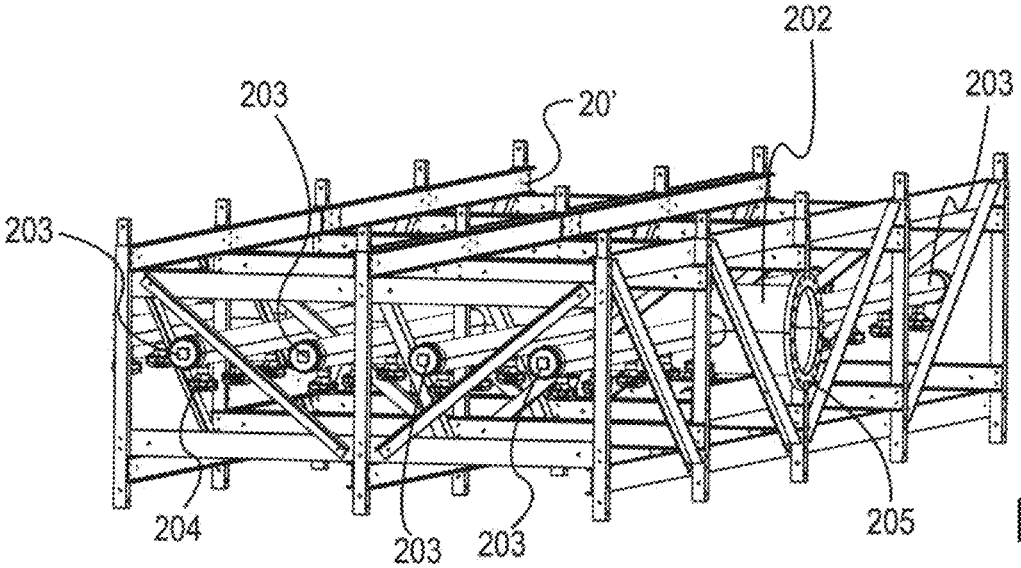
FIG. 19 is a second perspective view of the structural framework of FIG. 18.
Figure 20A:
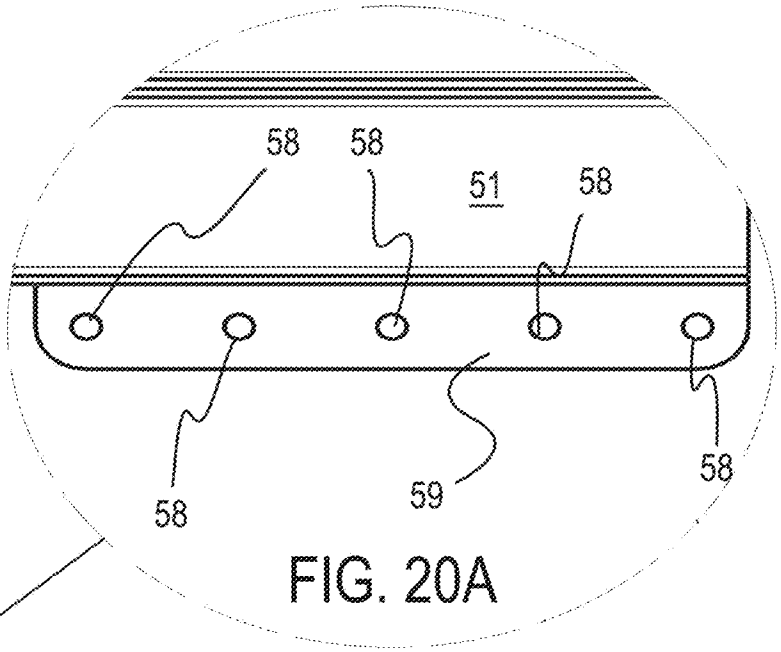
FIGS. 20 and 20A are a side plan view, and a magnified view, respectively, of an embodiment of the spreader platform of the present invention.
Figure 20:
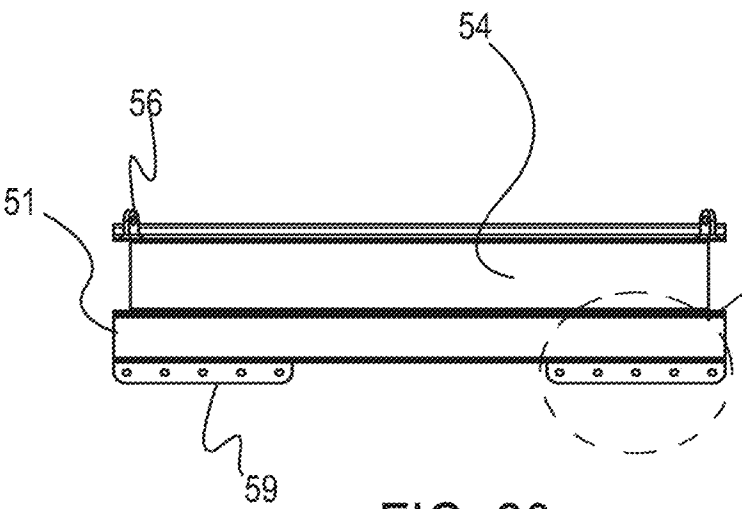
Figure 21:
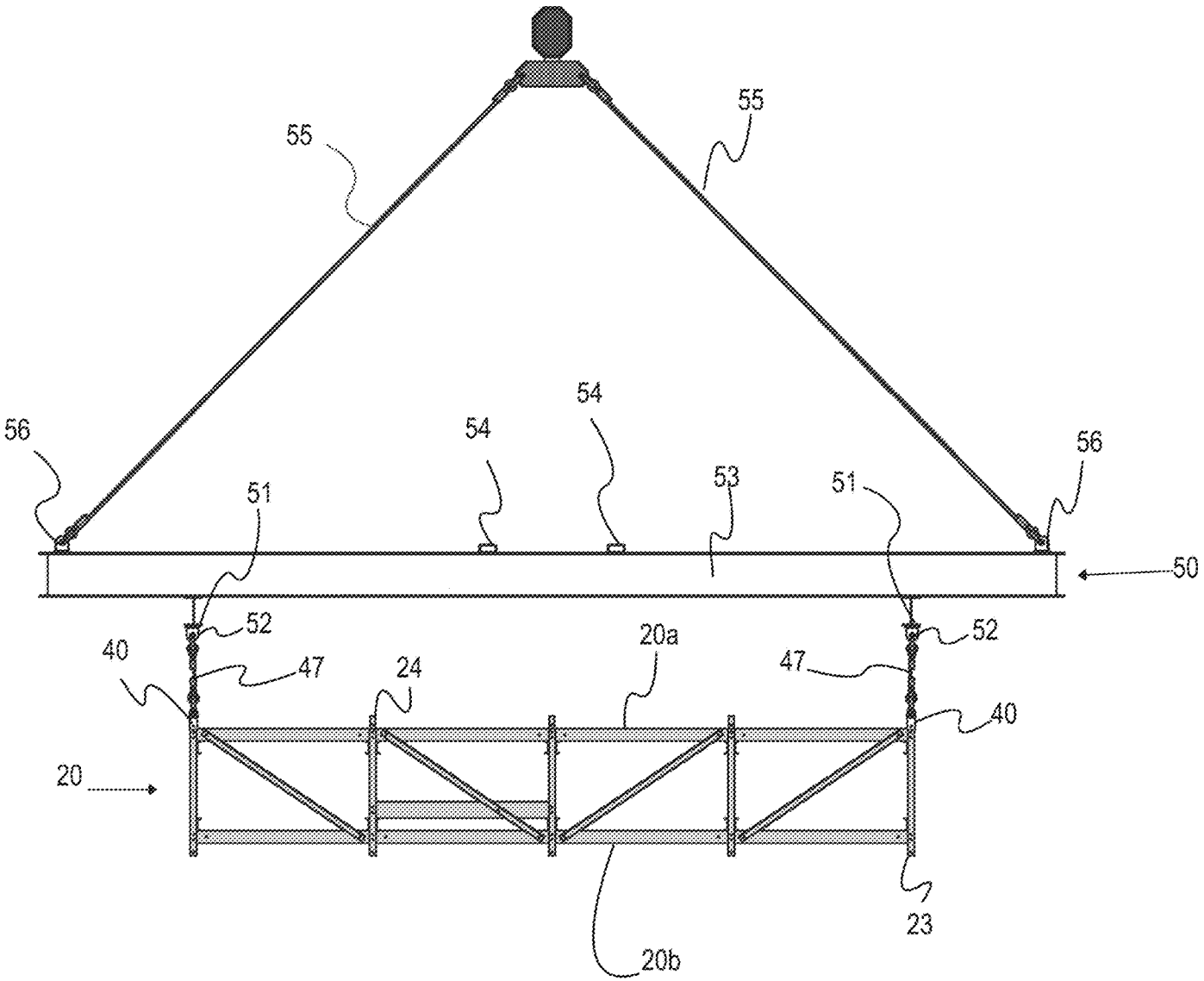
FIG. 21 is a side plan view of the spreader platform with attached module during construction.

Turning to FIGS. 17-19, an embodiment of a manufactured framework module 20' is depicted with a partial water distribution system 201 installed thereon prior to shipment of the module. In this embodiment, the module includes a header segment 202, to which is attached a plurality of feed tubes 203 equipped with spray nozzles 204 for distribution of hot liquid in a fully installed modular cooling tower cell. During installation of multiple modules 20' forming distribution module layer 220 of the cell, each module 20' header segment 202 may be installed to a header segment of one or more adjacent modules via a header flange 205, enabling fluid communication with the existing fluid inlet piping to form the water distribution system of the cooling tower cell. Unlike the modular cooling towers of the prior art, the water distribution system 201 of the present invention may be connected with existing inlet piping and pumps, maintaining the same related pump head pressures which are used in the cooling tower field 2000. In a related aspect, the invention may include installation of the fill media within a module layer prior to shipment or the installation of the drift eliminators.

An embodiment of the present invention makes use of modular male and female lugs to secure and install the modular cooling tower cell. The male lugs are of generally square construction, though other geometries for the lugs are not meant to be precluded. Each of the male lugs include a series of holes or openings and may be on one or more faces of the male lugs, such that a bolt may be received within the openings. The male lugs of the present invention are intended to be received within female lugs during construction. These female lugs are of a slightly large yet complementary structure, to enable the male lugs to be received. The female lugs additionally include complementary openings so that upon receipt of the male lug within the female lug, a bolt or other fastening component may be received within the male/female holes, securing the members thereto. In some embodiments, the mating connector 24 of the module 20 may include an alignment block 124, which may be integral with the mating connector 24 or of a separate construction which may be inserted within and detachable from the mating connector 24. As depicted in FIG. 29, alignment block 124 is of chamfered or tapered construction which aids the alignment of the male-female connection of the lug connections described herein. Alignment block 124 may be placed on any mating connector 24 on the vertical members 22 that comprise the module 20, or may even be placed within the mating connection of the column splices 6, 6' on the foundation beams 5. The alignment block 124 is advantageous in facilitating the mating connection between the male and female lugs of the present invention, providing necessary tolerances during installation which ensures proper alignment throughout the cooling tower cell.

With reference to the FIGS. 2-3, and 10-14, the method and structure of the present invention is described with respect to a preferred embodiment of a modular cooling tower, as an example, without limitation, of a field-erected, relocatable structure to be manufactured and constructed initially at a first location and then moved to a second location, where the final assembly and construction is completed on site. The manufacture and construction of the modules of the cooling tower cell at the first location can be ongoing while the modular cooling tower cell construction at the second location is being readied or while a previous cooling tower at the site location is being disassembled and removed, further limiting the construction time needed. As shown in FIGS. 3 and 10-13, the cooling tower structure of the exemplary embodiment includes bottom horizontal footing beams 5 for supporting the modular cooling tower cell, including framework module structures 20, 30 forming the cooling tower airflow module layer 110 of the mechanical section 200, as well as the remaining mechanical section 200 that is removably replaceable on top of the airflow module layer 110, and below stack section 300. The method includes the construction of a portion of a multi-portion structure where a portion is manufactured and constructed at the first location according to the specified module dimensions which would allow for construction of a cooling tower cell that may incorporate existing mechanicals after installation. Once manufactured and constructed, the modules which form the custom dimensions of the cooling tower cell are then moved to the second location, which in the prior art, would have been field-erected directly at the second location, unlike the implementation of the method of the present invention.

The modular construction of the present invention allows for construction of critical components of the cooling tower at different locations, one such location being at the site, and the other(s) at off-site facilities. The method further allows for modules of specified dimensions such that the cooling tower cell replaced may utilize existing inlet water piping and pumps of the former cooling tower cell which is to be replaced. With the assistance of a digital computer, which may include computer aided design (CAD) software and a database of modular cooling tower solutions, a data set unique to the cooling tower cell to be replaced may be generated which includes every parameter and dimension of the design elements forming the basis of the modules and other structures forming the modular cooling tower cell. These can include basin size data, cell size data, key elevations such as fill, header pipe, deck, etc. Utilizing the data set, manufacture of the modules may be customized on a job-by-job basis while allowing for the changing of parameters to expand or contract any dimension of the module to be built so that large scale changes which may occur at a second project or mid installation of a single project may be accomplished without further complicating the fabrication process of the modules or any other structures forming the modular cooling tower cells of the present invention.

The modular cooling towers of the prior art are lacking in that they cannot expand or contract dimensions of their modules to supply a cooling tower cell which would allow for the usage of a former cooling tower cells inlet piping and pumps. The present invention overcomes these deficiencies, allowing for an implemented design component which allows a cooling tower cell owner to replace a single cell, or even a plurality of cells in a bank, while simultaneously maintaining critical and expensive mechanical equipment of the preexisting cell after the installation of the modular cooling tower of the present invention. The design implementation allows for construction of modules which would accommodate any header pipe height of an existing cooling tower cell or bank across a plurality of installation sites. The plurality of designs is accomplished, in particular, using the consistent and single hole pattern 82 throughout the entire module structure. The single hole pattern 82 throughout the vertical and horizontal members of the module structure facilitates a plurality of connection points between brace member 26 and the rest of the module structure which facilitates rotation about the single hole pattern 82, almost acting as a pivot point during the design process, allowing for alteration of the connective angles $a_1$ and $a_2$ throughout a module structure without refabricating the hole design. The single hole pattern 82 therefore implements efficient automation and robotic fabrication when used with a design algorithm that is capable of expanding and/or contracting the dimensions of the framework members which create the module without the need to recreating a preexisting cell's dimensions at a modular scale. Unlike the modular cooling towers of the prior art, the hole pattern throughout the module structures of the modular cooling towers of the present invention allow for dynamic changes to the dimensions of the framework members which comprise the modules without changing any design considerations during assembly of the modules. Thus, design algorithm of the present invention allows for the design, fabrication, and assembly of modules forming a modular cooling tower cell which can be resized to any dimension without the need to significantly alter installation methodology to ensure the modular cooling tower cell of the present invention may accommodate the inlet water piping and associated pumps of the cooling tower cell which is being replaced. The design modality of the present invention ensures that a modular cooling tower cell may be constructed of any dimension which would allow the utilization of the former (replaced) cell's inlet piping and pumps.

After a cooling tower cell, which is in need of replacement, is selected and the data set has been generated, the method of fabrication of the present invention uses an algorithm to generate a module matrix of relevant dimensions which will form the structure of the modular cooling tower cell of the present invention. By way of example, the algorithm of the present invention may determine a preexisting cell having dimensions corresponding to a length L1, width W1 and Height H1. Included in the data set for the preexisting cell are a measured fill media height FH, main header height MH, drift eliminator layer DE, and a deck height DH. Utilizing the design algorithm of the present invention, a modular cell may be designed for construction in accordance with the example cell plan depicted in FIGS. 31 and 32. As depicted, the cell plan may call for a modular cooling cell composed of twelve (12) modules of a 2×3×2 framework matrix, though the configuration depicted is for exemplary purposes only, and other module configurations may be utilized to compose the preexisting cell which is in need of replacement. As depicted, the algorithm will establish a design for modules which may encompass the width W1 (formed using module width dimensions $W_a$-$W_h$), length L1 (formed using module length dimensions $L_a$-$L_d$), and the height H1. In determining the module configuration encompassing H1, the design algorithm first accounts for the height $H_f$ of the foundation beams 5 and determines key elevation dimensions taken from the data set which would allow for utilization of the inlet water piping and pumps of the preexisting cell (i.e., media height FH, main header height MH, drift eliminator layer DE, and a deck height DH). Using these key elevations, the algorithm of the present invention determines the height dimensions necessary for each module layer 110, 210, 220, and 230, which when taken in combination with foundation beam height $H_f$ (as depicted Ha-He), creates the overall height H1. Each project designed by the algorithm of the present invention may generate a complete specification for the specific project, including 3D models, construction drawings, assembly drawings, fabrication drawings, engineering calculations, bill of materials, framework member cut lists, material cost estimates, etc. Thus, the design algorithm of the present invention is capable of constructing a manufacture plan utilizing the single hole pattern 82 on the framework members of the module which can alter the dimensions of the framework members without changing the hole pattern 82 connective points which allows for a modular recreation of an original cell. The modular cooling tower cell of the present invention may therefore create a stable structure which can reuse the inlet water piping and related pumps of the preexisting cell, dramatically reducing labor cost, material cost, and overall time for installation.

Figures 6, 6A:
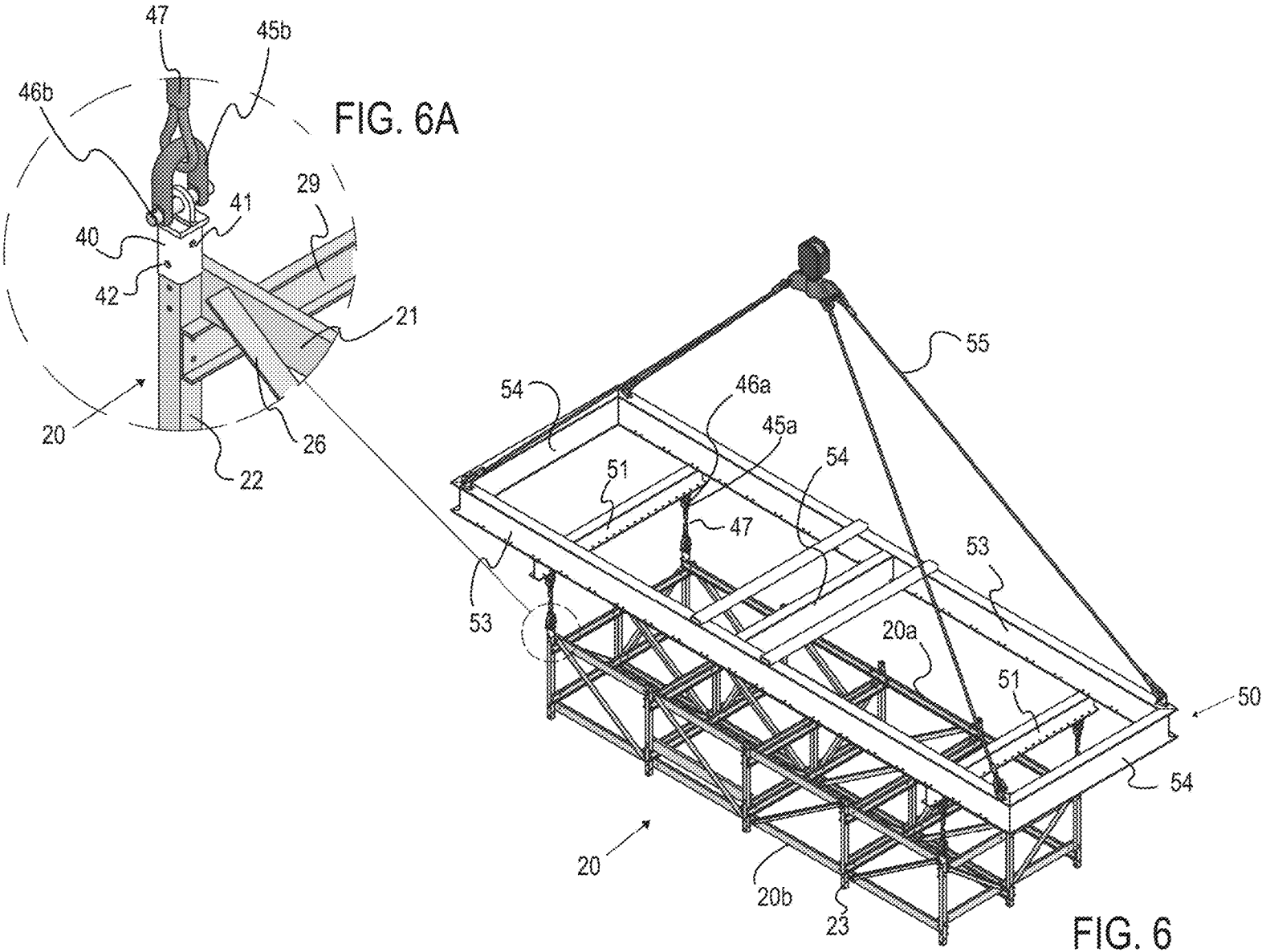
FIGS. 6 and 6A is a close-up perspective view, and magnified view, respectively, of the use of the spreader platform with lifting members and modular subassemblies during installation of the modular cooling tower of FIG. 5.
Figure 7:
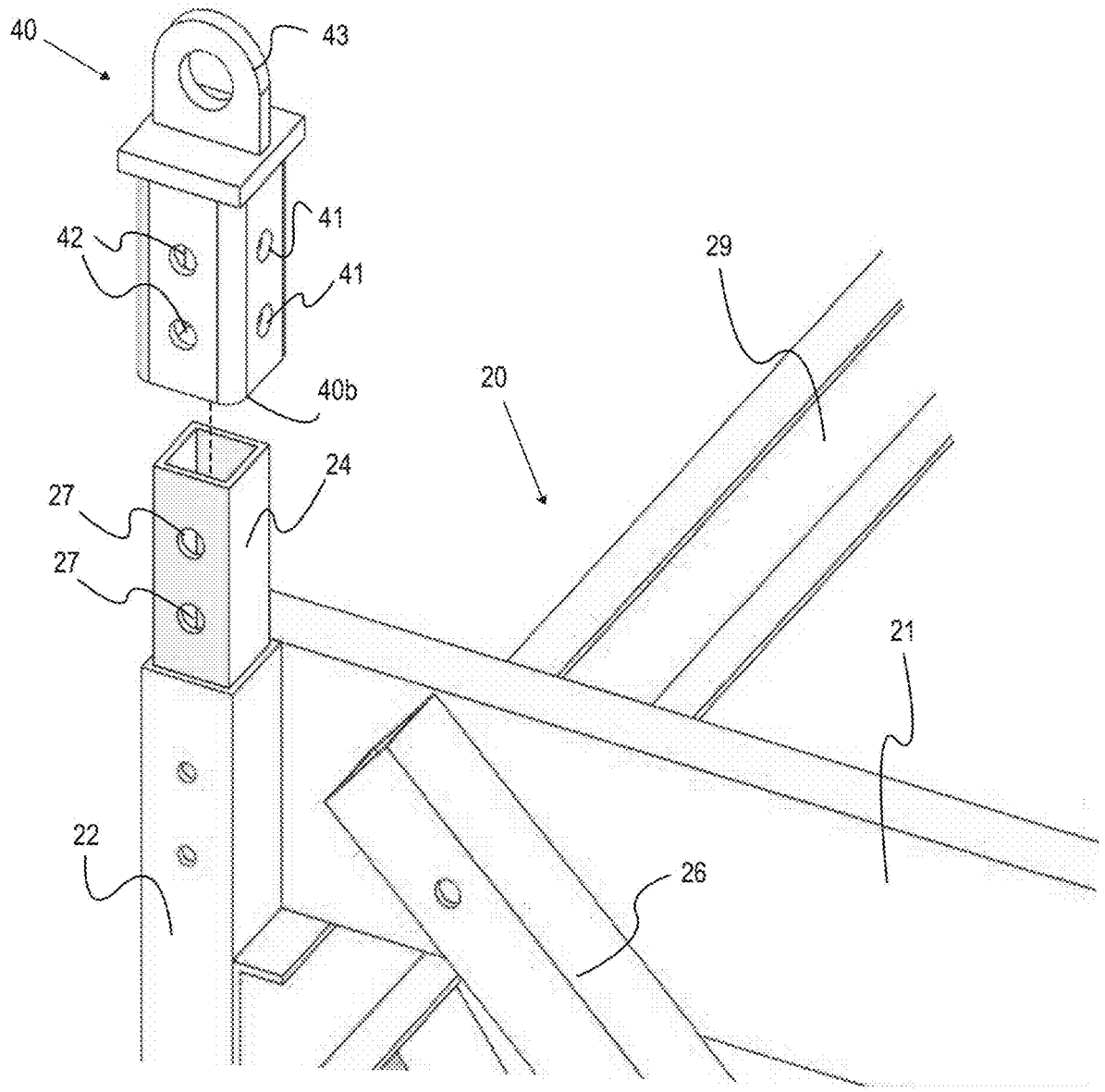
FIG. 7 is a partial exploded view of the lifting lug technology depicted in FIG. 6.
Figure 9A:
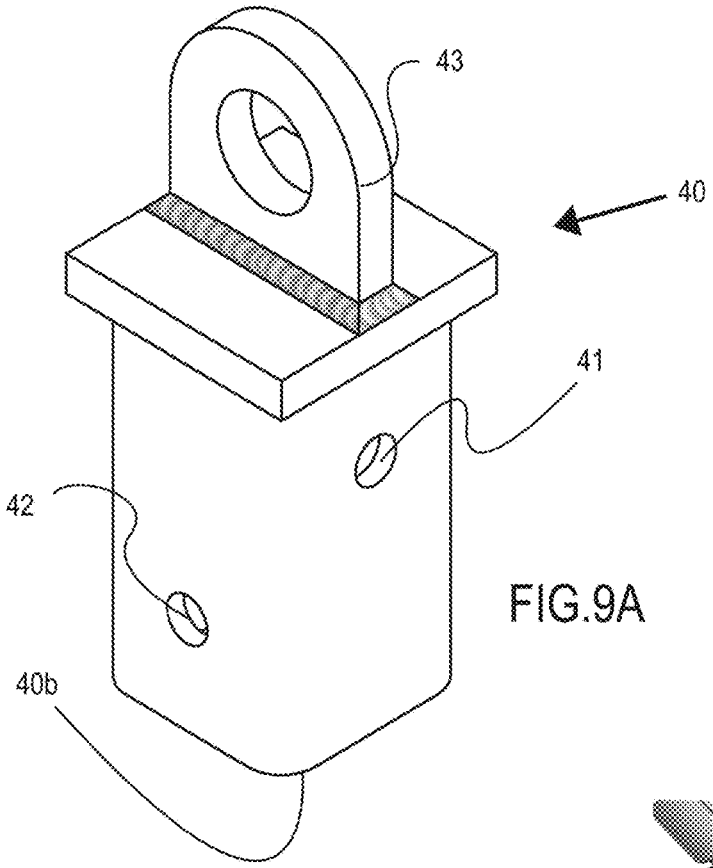
FIG. 9A is a is a close-up perspective view of the lifting lug of FIG. 7.

The construction method of the embodiments shown for the present invention need not use any specialized equipment to lift and move the structure to a position of installation for the cooling tower cell. However, in one embodiment of the present invention the method is efficiently and effectively carried out in part using a lift device connected by cables 55, for example four cables, to spreader platform 50 that is capable of supporting, balancing, and lifting a structure by lift members 40. As depicted in FIGS. 6, 7 the connection between lift member 40 and a module structure 20 is shown. Lift member 40 is shown of a female lug construction, though other configurations, including male lug configurations are not precluded. In the depicted embodiment, lift member 40 has a bottom (female) receiving aperture 40*b*, that receives the vertically extending portion of male connector 24. Lift member 40 includes through-holes or apertures 42, typically on opposed surfaces of the lift member, and potentially a second set of through-holes/apertures 41 on a transverse face of the lift member (see also FIG. 9A). Lift member 40 further includes a top portion having an eyelet 43 which may be secured to lift member 40 by, for example, welding or any other means of attachment which would be known by a person of skill in the art. Lifting member 40 is secured to a spreader platform 50, which is described in further detail below. Lift member 40 is designed to be secured to a corresponding male lug, for example lugs 24 of a module structure 20 being moved into a second position, by way of through-holes 41, 42 on the lug. Lift member 40 is secured to the module 20 framework using carrier bolts or other similar fasteners known in the art through apertures 27 on the framework structure connectors. In a similar fashion, the lift member 40 receiving aperture 40*b* can receive the column splices 6 of the foundation beam 5 and secure thereto so that beams 5 may be lifted using spreading platform 50 to place the foundation beams across the bottom, water constraining basin foundation 1.

Figure 5:
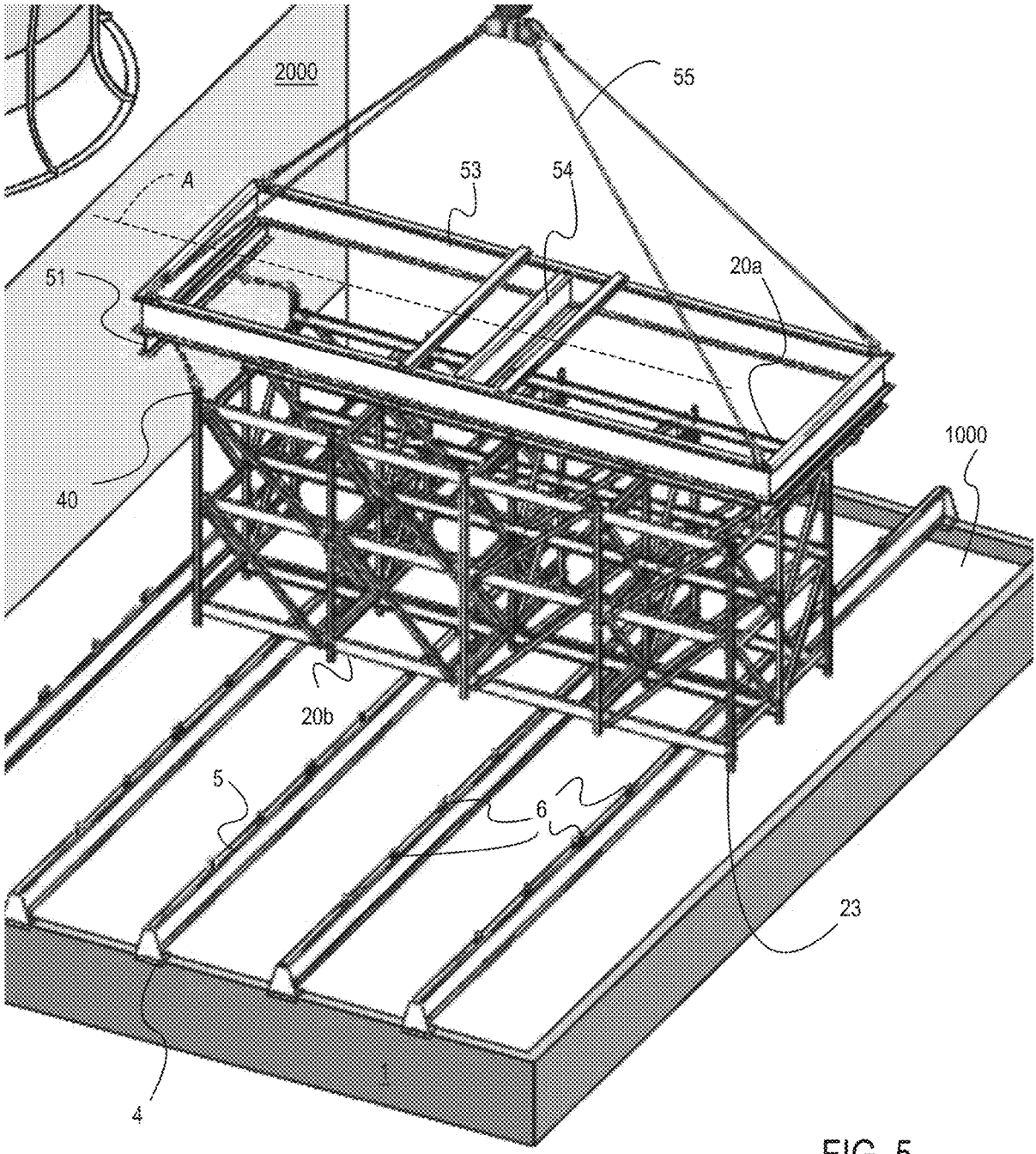
FIG. 5 is a perspective view of the modular cooling tower of the present invention while construction is in progress.

FIG. 5 shows the spreader platform 50 being used to position a framework structure in accordance with the method of installation, which is described further below. The structure to be lifted and moved is connected to spreader platform 50 by a plurality of lift cables 55, which may include shackles and clevis pins, evenly spaced lengthwise and widthwise along beams of spreader platform 50 to distribute the weight and to support and balance the framework structure to be lifted. The lift cables 55 connecting spreader platform 50 to the lifting component may be any number of cables to sufficiently support the spreader platform 50. In connecting the shackles on the lift cables 55 to the spreader platform 50, platform eyelets 56 are evenly spaced lengthwise and widthwise along beams of the spreader platform 50 to connect the lift cables 55 to the lifting device. The platform eyelets 56 may be attached to the upper surface of the beams of the spreader platform 50 through any means, such as through welding or by attaching the eyelets 56 through fasteners.

Figure 4:
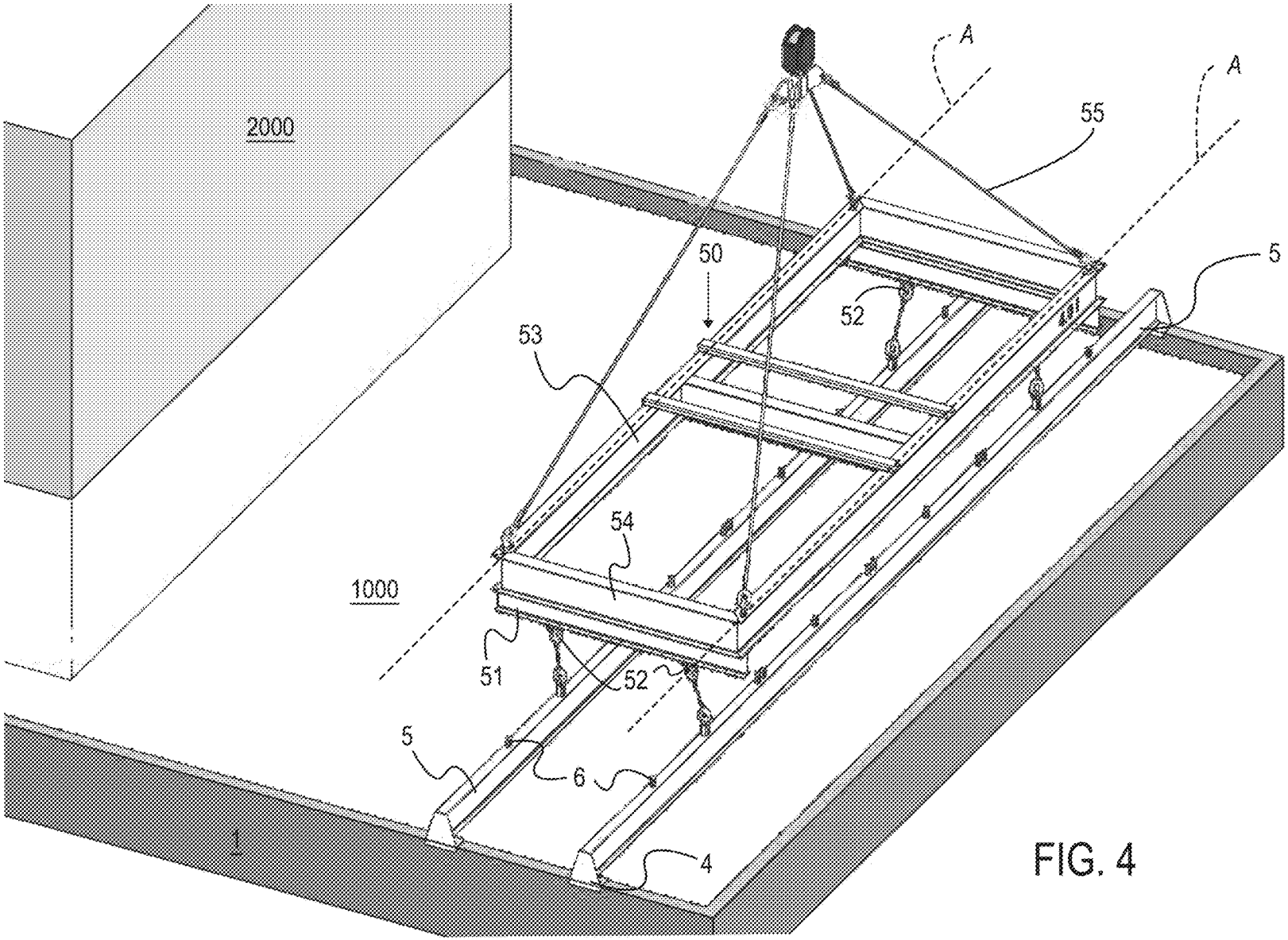
FIG. 4 is a perspective view of the modular cooling tower of the present invention during installation of the foundation beams depicted in FIG. 3.
Figure 9B:
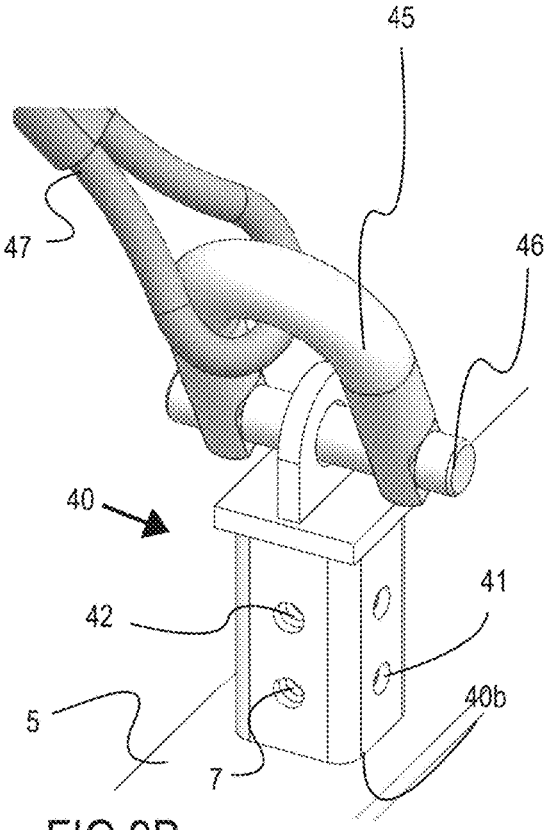
FIG. 9B is a close-up perspective view of the steel beam footings and complementary lifting lug of the present invention during installation.

As best shown in FIGS. 4, 6 and 9B, the lift members 40 connected to the spreader platform 50 are illustriously presented. For each lift member 40, securing members including a metal cable 47 is attached at its upper end to a support structure, such as a U-shaped retainer (pin shackle) 45*a*, held by a pin 46*a* in a framework structure lift eyelet 52 secured, preferably by welding or by other type of fastening, such as bolts and nuts, to a lift beam 51, as depicted in FIG. 6. The lift beams 51 are supported by at least two carrier beams 53 of the spreader platform 50 to be described in more detail below. The lower end of the metal cable is connected to a second support structure and pin 45*b*, 46*b* in a manner similar to the upper end of the cable to the lift member eyelet 43. As shown in FIG. 6A, the second support structure and pin 45*b*, 46*b* are releasably attachable to lift member 40. In this manner, structures utilizing the male/female connections lugs of the present invention can be lifted, properly placed, and secured via one or more lift members 40.

Usage of the lifting lug during construction of the cooling tower cell of the present invention can be seen as depicted in FIGS. 6 and 7. Module 20 is shown attachable to lifting lug for the purpose of lifting and relocating module 20 via a spreader platform 50 (described below). On an upper surface 20*a* of the module, male lugs 24 are shown which may be integral with or attached to the vertical members 22 of the module 20. The male lugs 24 extend vertically upwards along the vertical axis of the vertical members 22, presenting an attachment mechanism for insertion within corresponding female lugs, which may be for example, a female lug 23 of a second module structure during assembly. Female lug 23 may be located opposite male lug 24 on each vertical member 22 of a module structure 20. While the module male lugs 24, foundation beam column splices 6, and female lifting lug are depicted as being square in horizontal cross-section, other cross-sectional shapes are permitted, and tubular male lugs are also not meant to be precluded. In the exemplary embodiment, the lower lugs of a module 20 are female lugs 23, but the male and female designations may be interchangeable in this design. That is, in some embodiments, the upper framework structure may contain female lugs, or any combination male and female lugs, and vice versa for the lower portion of the framework. In an exemplary embodiment, the male and female lugs have apertures therethrough to receive attachment bolts; however, other connection schemes are not precluded. The design envisions a male/female connection that can support lifting the framework structures and be easily detachable. In the embodiment of FIG. 7, each male lug 24 is shown with two apertures or openings 27, but may include any number of apertures or openings through the outside surface of the lug.

The spreader platform of one or more embodiments of the present invention is shown best in FIGS. 4, 5, and 6. The spreader platform comprises at least two transversely spaced longitudinal carrier beams 53, each preferably in the form of an I-beam having an I-shaped cross-section transverse to a longitudinal direction A along the beam. The carrier beams 53 are preferably made of steel and are of such a size and composition to safely support the weight of the remainder of the spreader platform and any structure supported by the spreader platform, although other strong, relatively stiff materials, are not precluded.

On the top surface of the carrier beams are at least a pair of platform connectors, such as eyelets 56, spaced to evenly balance the load and adapted to be connected to lifting cables of a lifting device. The platform eyelets 56 are preferably welded to the carrier beams 53, though they may similarly be attached through bolts and nuts, or other similar materials known in the industry. Shackles and clevis pins are utilized to connect the platform eyelets 56 to the cables 55, which are in turn connected to the lifting device. The spreader platform 50 also includes a plurality of longitudinally spaced transverse lift beams 51 spaced along the length of and generally perpendicular to and supported by the carrier beams 53. The transverse lift beams are of a similar construction to the carrier beams 53. The carrier beams 53 may be further supported by one or more brace beams 54, spaced along the length of and generally perpendicular to the carrier beams 53, such that the brace beams 54 support the load to be lifted by spreader platform 50, and also provides structural stability and integrity, allowing large loads to be lifted by the spreader platform 50 without exhibiting undue torque forces that could otherwise twist the platform. In one aspect of the invention depicted at FIG. 20, transverse lift beams 51 may include a coupling assembly 59, having a plurality of apertures 58, to account for the range of acceptable module dimensions in the database of solutions, for receiving the U-shaped retainer 45*a* of the securing members to change the position in which lift member 40 is secured to a structure to be lifted, further preventing twisting or swaying of the spreader platform or structure lifted during installation of the cooling tower cell of the present invention. The design structure of the spreader platform 50 is parameterized to expand or contract to any dimension of the module within the database of solutions.

Figure 3:
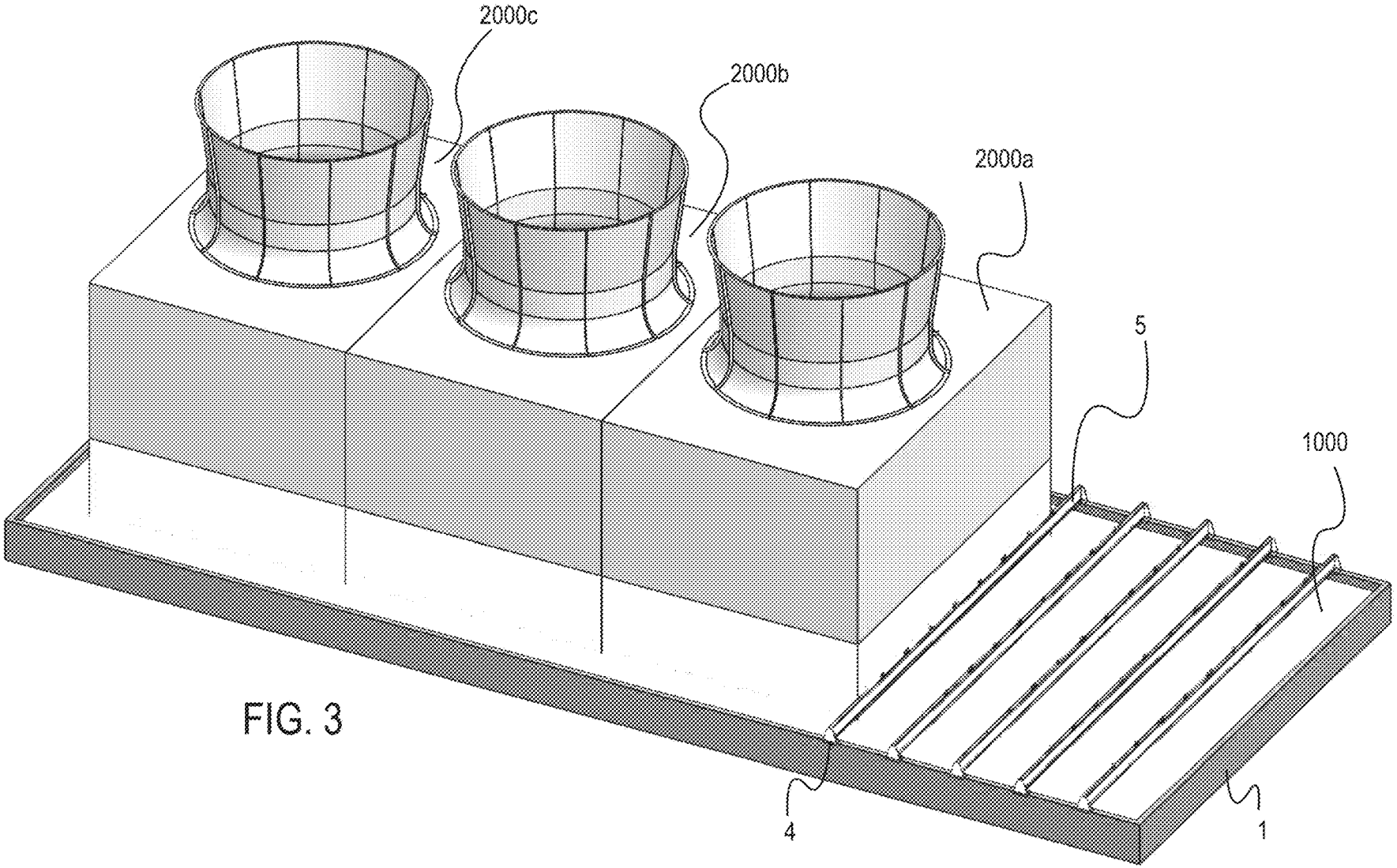
FIG. 3 is a perspective view of the modular cooling tower at initial construction utilizing the foundation beams of the present invention.
Figure 24:
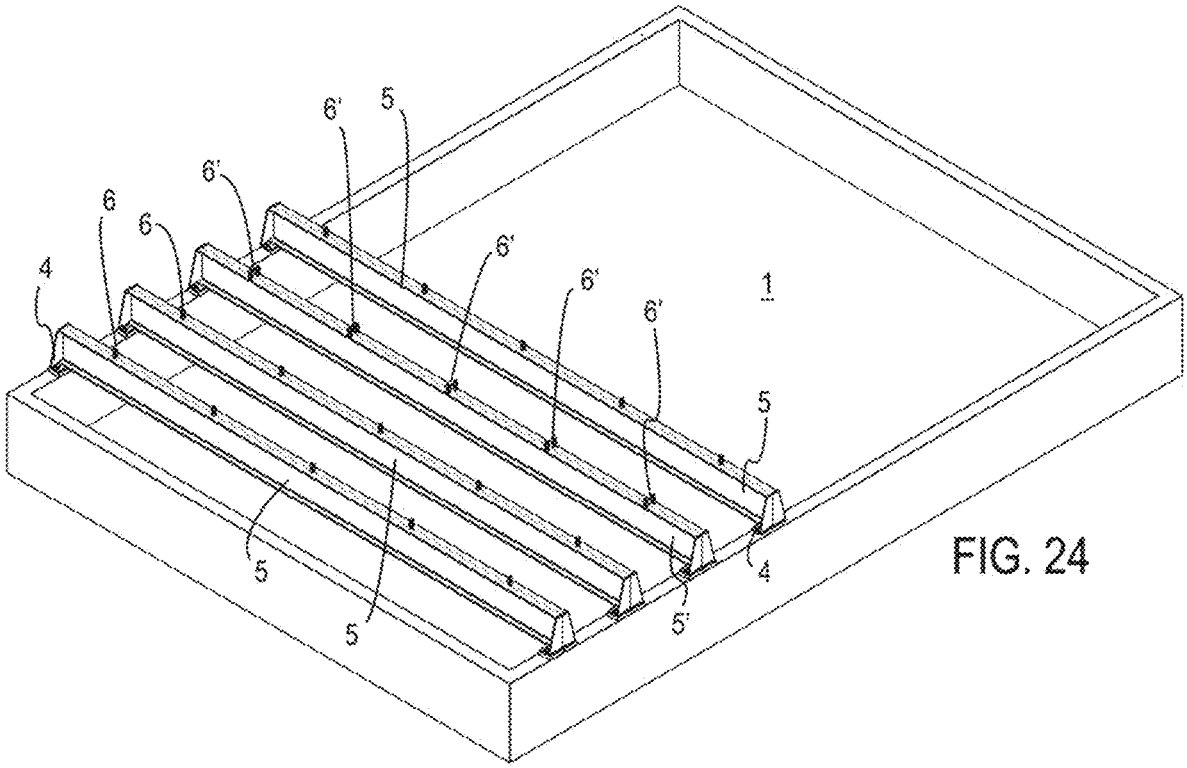
FIG. 24 is a perspective view of installation of the foundation beams of the modular cooling tower cell of the present invention during construction.
Figure 25:
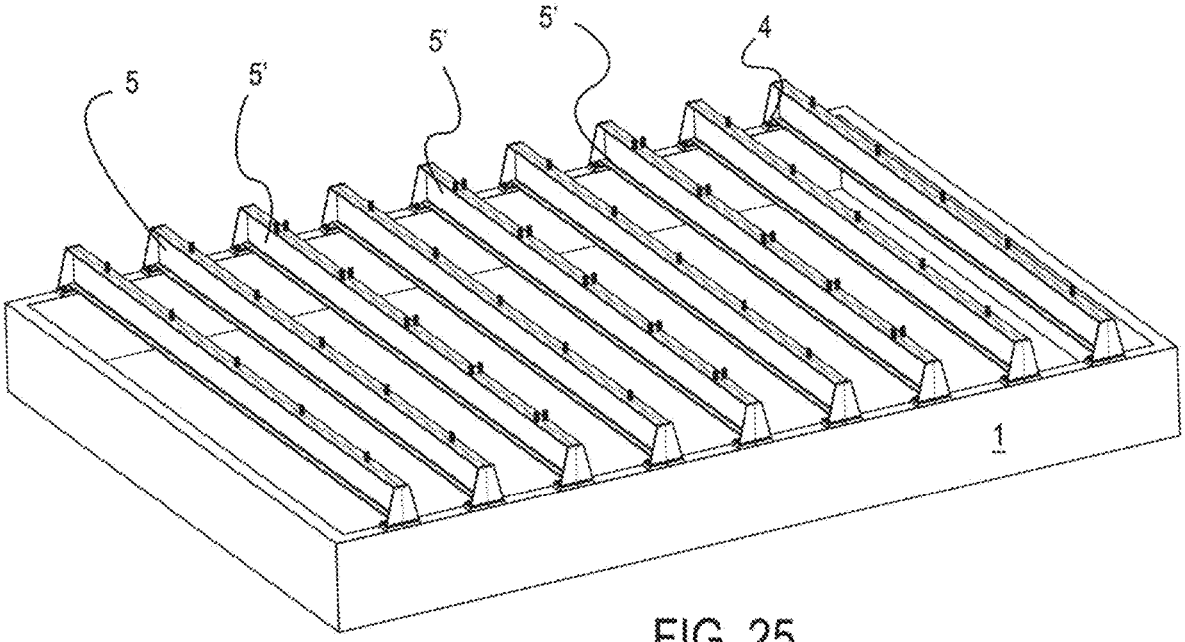
FIG. 25 is a perspective view of installed foundation beams of the modular cooling tower cell of the present invention during construction.

After deconstruction of an existing cooling tower cell, while other cooling tower cells within the field or bank remain in place, horizontal foundation beams 5 are placed to form the footing support for the modular cooling tower cell during installation. The placement of these beams provides for a complete footing of one modular tower cell while maintaining (and not deconstructing) the adjacent cooling tower cell(s) within the field. As shown in FIGS. 3 and 24, installation of the modular cooling tower is depicted with foundation beams 5 which extend across the basin foundation 1, forming the base floor of a singular modular cooling tower cell, and may be of any heavy-duty material, such as steel, or any other material commonly used within the art. The top face of foundation beam 5 includes a plurality of male lugs or column splices 6 along the length of the beam, which project in a direction opposite the footing anchors 4, located at opposing ends of each foundation beam 5, which supports the beam across the basin footing 1. These footing anchors 4 are designed to anchor and level the steel beam on the edges of the basin foundation 1 so that the entire construction of the beam may be elevated above the live liquid-filled basin during construction of the cooling tower. In this manner, the construction of the cooling tower cell may be performed in-situ, i.e., while the rest of the cooling tower field remains in place and may optionally continue to be operational, eliminating the need to terminate the operation of other live cooling towers within a cooling tower field. While the foundation beams depicted in FIG. 24 include a single row of male lug projections or column splices 6 along the beam length, in one or more embodiments, the foundation beams may include a double spliced column splice projection pattern 6' spanning the foundation beam 5' length, as shown in FIG. 25. Utilizing the double splice column splice projection pattern 6' allows for multiple module framework structures 20 to be placed on a single beam (see FIG. 23). After placing beams 5 across the basin foundation 1, anchors 4 located at opposing ends of each beam are secured to maintain the edge of the basin 1. As depicted in FIGS. 28A to 28C, proper alignment along the foundation beam is achieved by utilizing anchor fasteners 94 along the anchor 4 such that they extend through an interior portion of the basin 1, and may be adjusted during the initial installation to ensure foundation beam 5 is plumb, level, and square to the basin 1 as well as other foundation beams. A grout 95 is then subsequently added between the anchor 4 bottom surface and topmost surface of the basin 1, thereby fixing the foundation beam to the basin 1 and providing sufficient bearing capacity to support the cooling tower loads. The beams 5 are preferably fabricated from material having sufficient strength to support the weight of the modular cooling tower, such as steel.

To move foundation beams 5 into position across the basin 1, the lift members 40 of the spreader platform 50 are secured to one or more foundation beams 5 by securing each of the lift members 40 to column splices 6 of the foundation beam 5 so that foundation beam 5 may be lifted by the spreader platform 50 and moved over the basin footing structure 1. As shown in FIG. 4, the lifting device has moved the spreader platform 50 and attached foundation beams 5 to a position over the basin footing so that they may be secured to the edges of the basin 1 as described above, forming a platform for securing one or more modules 20 thereto (see also FIG. 23), which will form the lower airflow module layer 110 of the modular cooling tower cell. The foundation beams 5 are secured over the live basin filled with cooled liquid 1000, and may be placed adjacent a currently operational cooling tower cell 2000.

Figure 8:
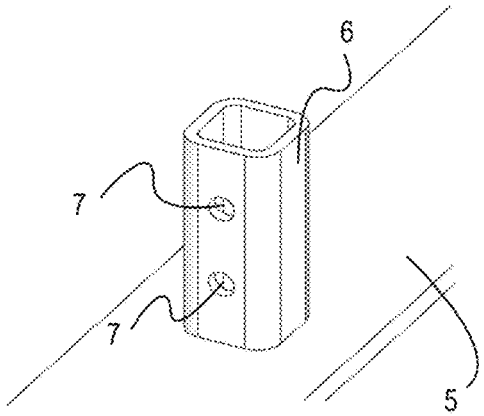
FIG. 8 is a close-up perspective view of the steel beam footings of the present invention.

FIGS. 8 and 9B depict the foundation beam 5 attachment to the lift member 40. In a similar manner to lifting operations of the module framework structures 20 described in detail below, a male/female attachment structure is presented for elevating the foundation beams 5 and placing them in position across the basin footing 1. In the disclosed embodiment, male lugs or column splices 6 are shown fastened to foundation beam 5. The column splice 6 may be fastened by weld or other attachment means provided the attachment strength is sufficient to bear the portioned weight of the modules after attachment to foundation beams 5 and provides adequate construction flexibility for in field adjustments and erection tolerances. In one or more embodiments depicted in FIGS. 30A and 30B, the column splices 6, 6' may include a shim plate 405, 405' attached or otherwise secured thereto for enabling adjustment of the column splices 6, 6' along the longitudinal axis of the foundation beam or perpendicular thereto for facilitating connection between a female lug connector 23, 40*b* and the column splices 6, 6' during installation of the modular cooling tower of the present invention. Lift member 40 has a female bottom receiving end 40*b* for accepting column splice 6, and each connector portion has aligned apertures 42 with the openings 7 on column splice 6 for accepting a bolting segment therethrough. While the lug structure is exemplary, it is not intended to be limiting, and other configurations of attachment are not meant to be precluded. In at least one embodiment, the foundation beams may include cavities for receiving the lug. In other embodiments, the foundation beam may be attached via metal anchors and tethers. Once the foundation beams are in their final position, the column splices 6 are detached from the lift members 40 so that the spreader bar may be subsequently utilized to move one or more additional foundation beams 5 to their final position.

The fabrication and assembly of this new footing platform, formed by the securing of foundation beams 5 to the basin footing alleviates the need to deconstruct multiple cooling tower cells in order to replace the newly added single cooling tower module, and allows for the construction to occur in-situ, or during operation of the remainder of the cooling tower field.

Figure 10:
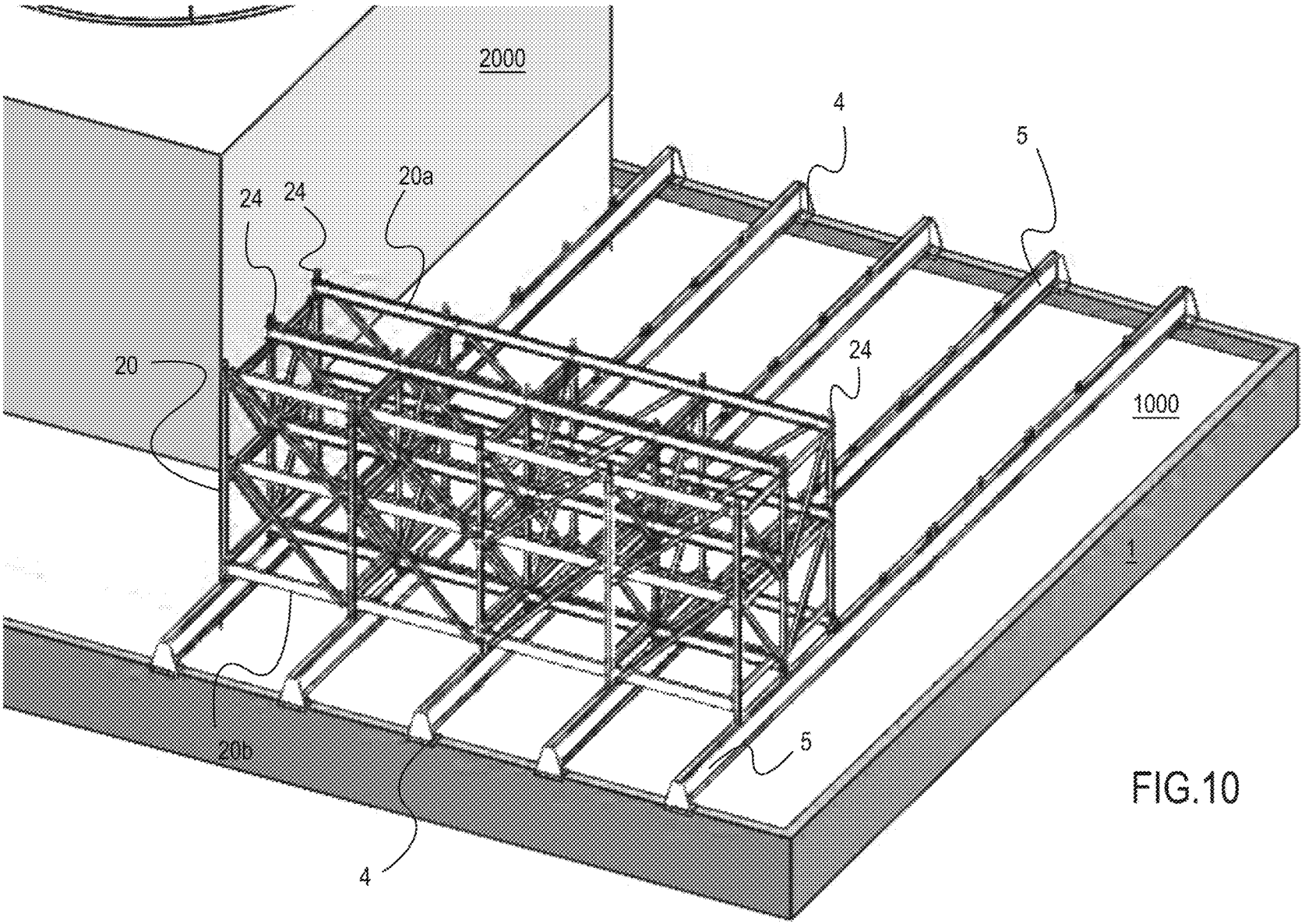
FIG. 10 is a perspective view of the modular cooling tower of the present invention during construction depicting a portion of the structural frame assembled on foundation beams.
Figure 11:
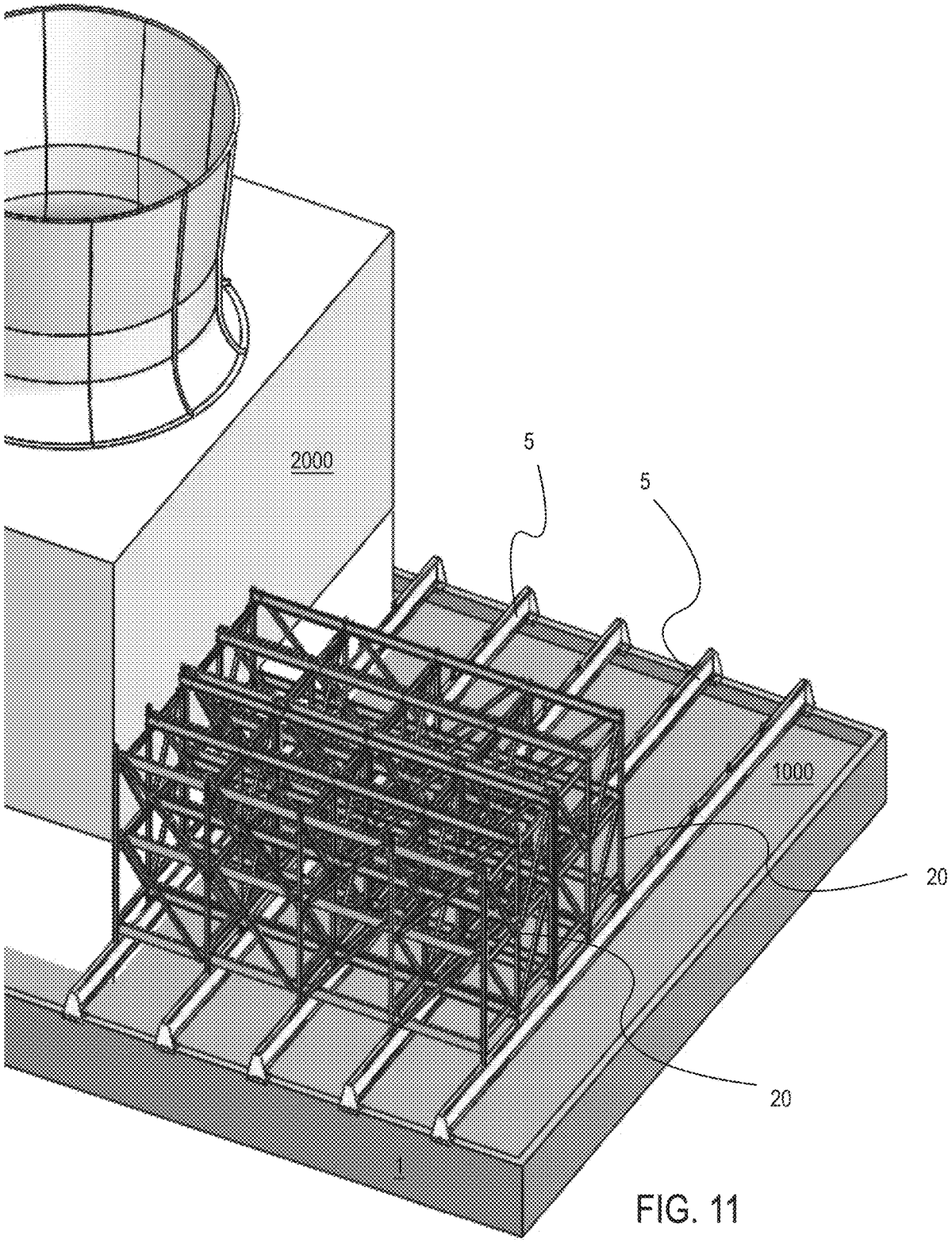
FIG. 11 is a perspective view of the modular cooling tower of the present invention during construction depicting additional portions of the structural frame assembled on foundation beams.
Figure 12:
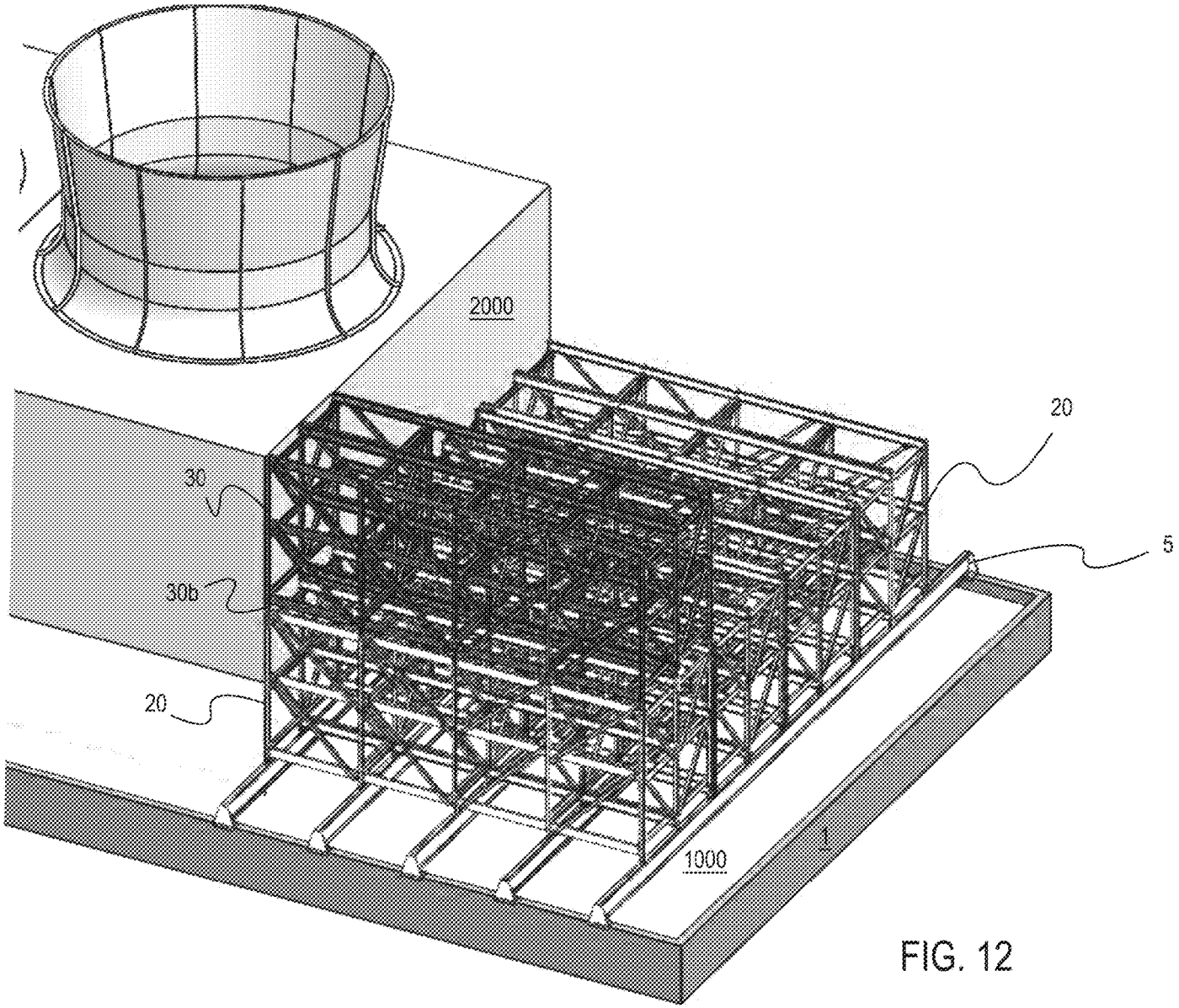
FIG. 12 is a perspective view of the modular cooling tower of the present invention during construction depicting a second tier of structural frames assembled on top of a first tier, with distribution piping and media fill portions removed.

FIGS. 5, 10, and 11 depict the method of forming the lower airflow module layer 110 of the modular cooling tower cell of the present invention. Once foundation beams 5 are in their final position, the spreader platform of one or more embodiments of the present invention may begin to move the modules 20 forming the airflow module layer 110 into their final positions. Once framework module structure 20 is in position to be lifted by the spreader platform 50, lift members 40 are secured to the corresponding male lugs 24 on the module upper surface portion 20*a*. The lifting device then moves the spreader platform 50, which holds secured via lift members 40 the module structure 20 which will form the upper layer of basin section 100 of the cell. The module 20 is moved into a position above foundations beams where it can be subsequently lowered such that the female lugs 23 on the opposing end of the module 20*b* are fit within the column splices 6 on the foundation beams 5, and are subsequently secured to one another by use of one or more fasteners. The lift members 40 are removed from the male lugs 24, and the spreader platform 50 will be moved again to position a subsequent piece of framework 20 onto the foundation beams until the airflow module layer 110 of the cooling tower cell is completed.

Figure 13A:
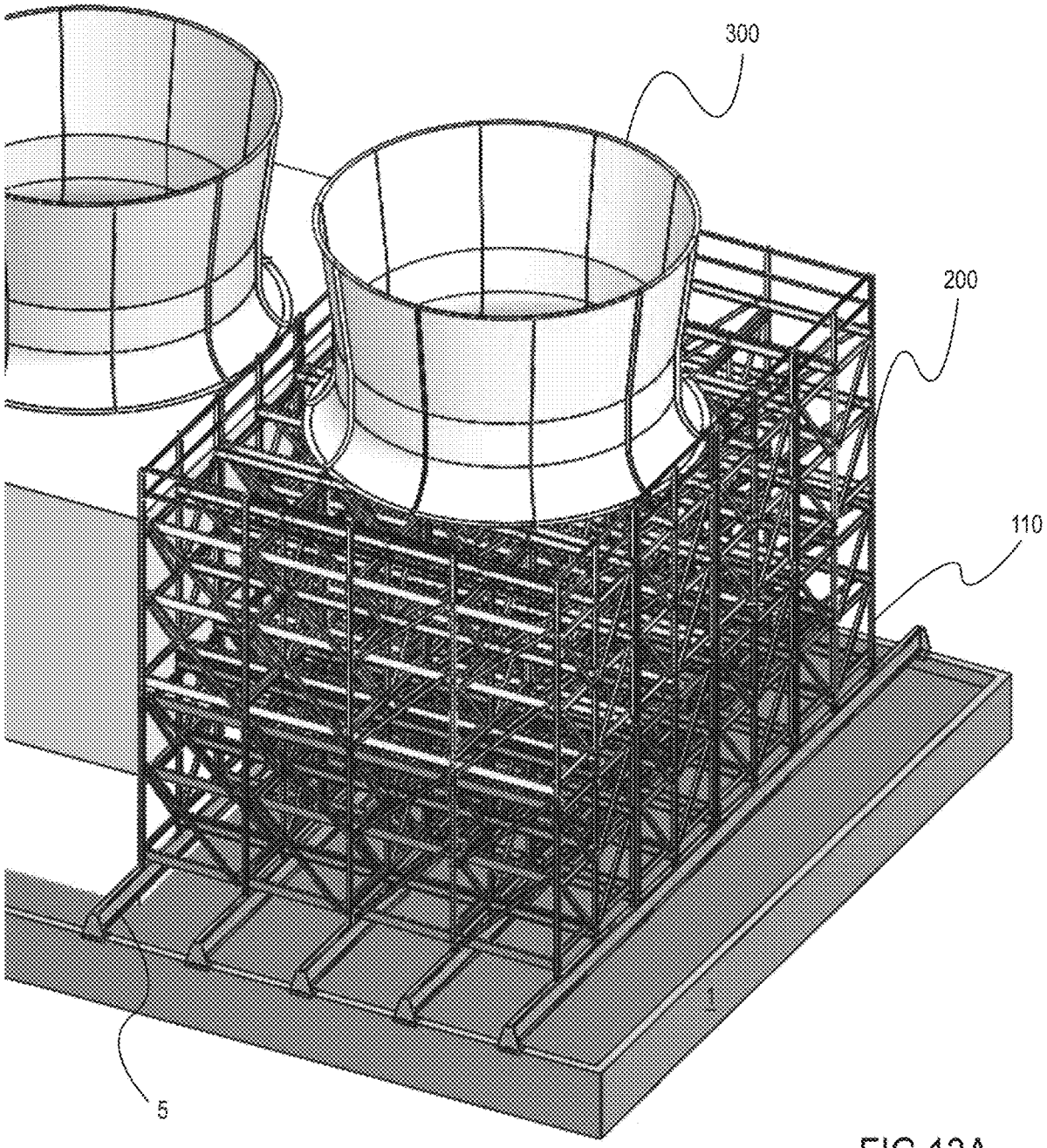
FIG. 13A is a perspective view of the modular cooling tower of the present invention during construction depicting the assembly of the stack on a completed structural framework, with distribution piping and media fill portions removed.
Figure 13B:
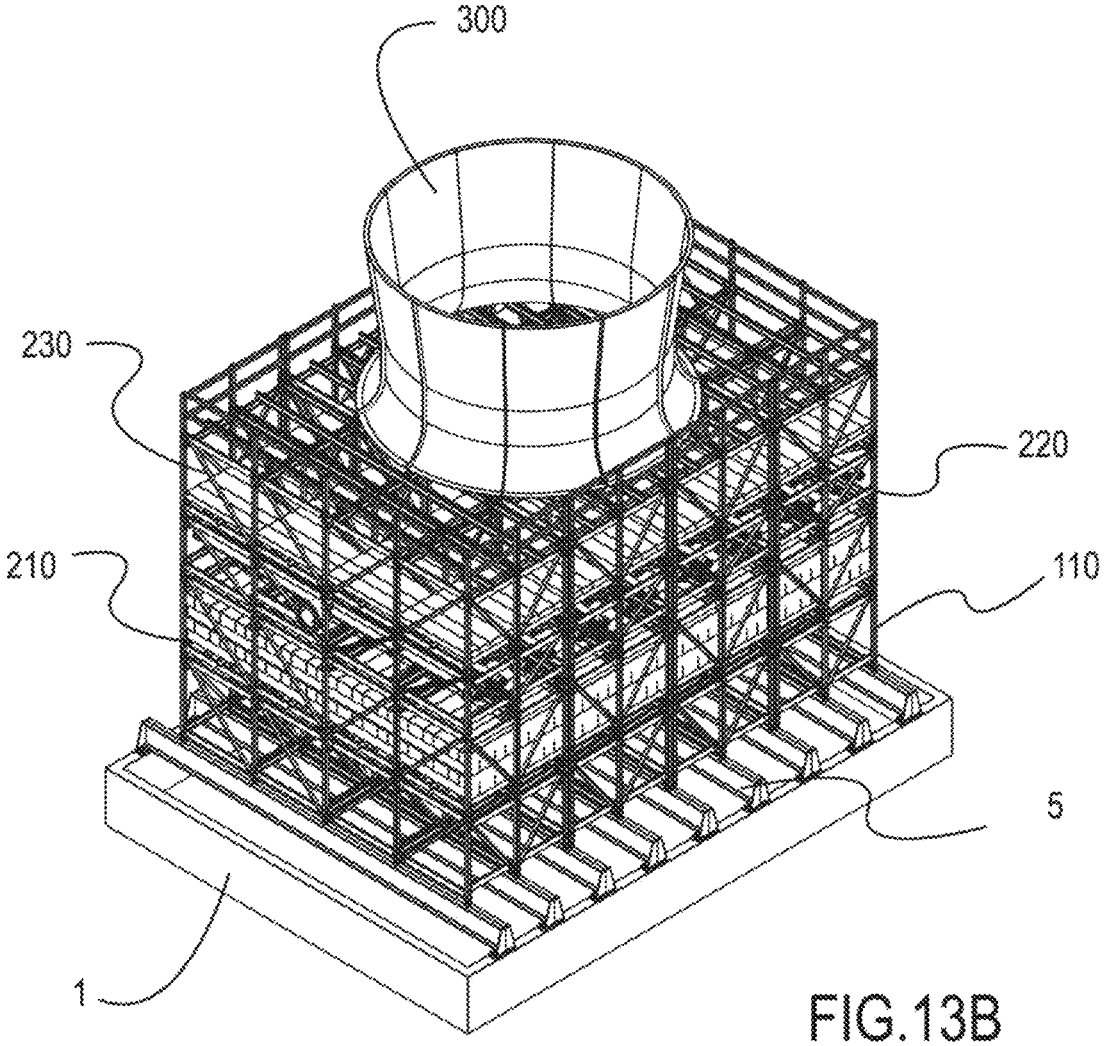
FIG. 13B is a perspective view of an embodiment of an isolated modular cooling tower of the present invention during construction.
Figure 14:
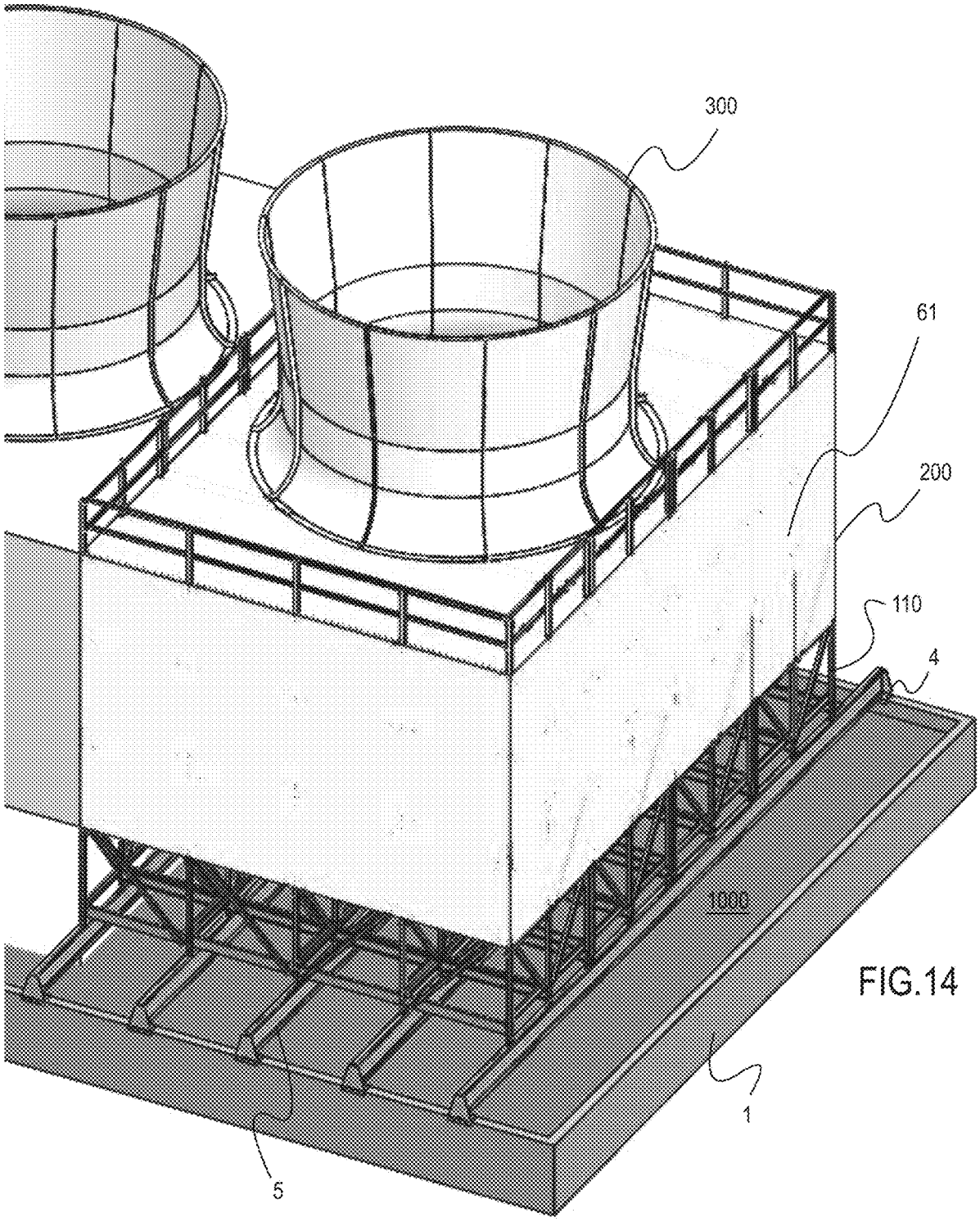
FIG. 14 is a perspective view of the modular cooling tower of FIG. 13B during further construction.

After completion of the airflow module layer 110 and basin section 100, the remaining structural framework section 200 may be constructed in a manner similar to placement of the airflow module layer 110. Spreader platform 50 and lift members 40 are secured to the module forming subsequent layers of structural framework section 200 (e.g., fill media module layer 210, distribution module layer 220, and/or drift eliminator layer 230) via complementary male/female lug interconnection of the module lugs 24 and lift members 40, and the lifting device subsequently raises and moves the second module 30 into the position above the first module 20. As shown in FIGS. 13A and 13B, the second module 30 has been lowered into place above the first module structure 20, and the female lugs 23 on the bottom end 30*b* of the second framework structure 30 are fit within the male lugs 24 on the first framework structure 20. After interconnecting the male and female lugs, the apertures 27 of the male lugs 24 on the first, lower module 20 correspond to the apertures 37 on female lug 23 of the upper, second module 30. Thus, the connection of the upper framework structure 30 to the lower framework structure 20 may then be secured to one another through carrier bolts, or other similar securing devices known in the art. After attachment, lift members 40 are detached from the second structure 30, so that the remaining modules which form the structural framework layer 200 may be installed. The method of construction of the modular cooling tower described herein allows for increased productivity by allowing the modules 20 forming the airflow module layer 110, fill media module layer 210, distribution module layer 220, and/or drift eliminator layer 230 to be fabricated and assembled at a manufacture location prior to assembly of the cooling tower on a field site. Once completed and shipped to the field site, the male/female lug configuration allows for entire module framework portions to be assembled in an expedited manner, and also allows for the cooling tower field 2000 and liquid basin 1000 to be operational during the construction period.

Figure 27:
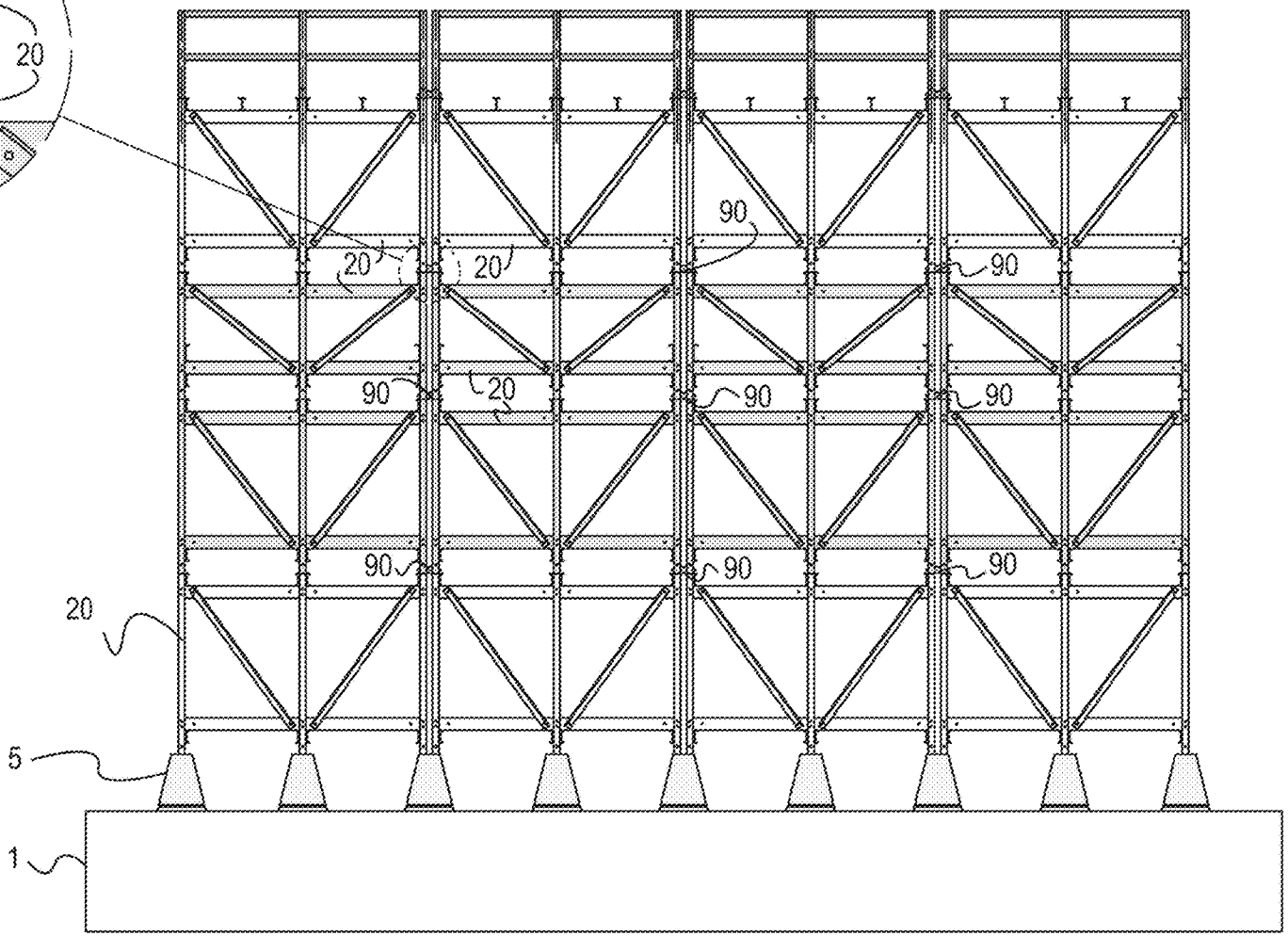
FIG. 27 is a side plan view of the width of the structural framework of the modular cooling tower of the present invention.
Figure 27A:
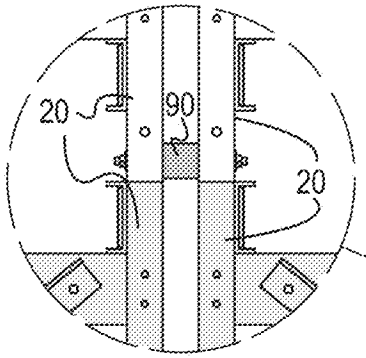
FIG. 27A is a magnified view of an interconnection joint of the structural framework of FIG. 27
Figure 31:
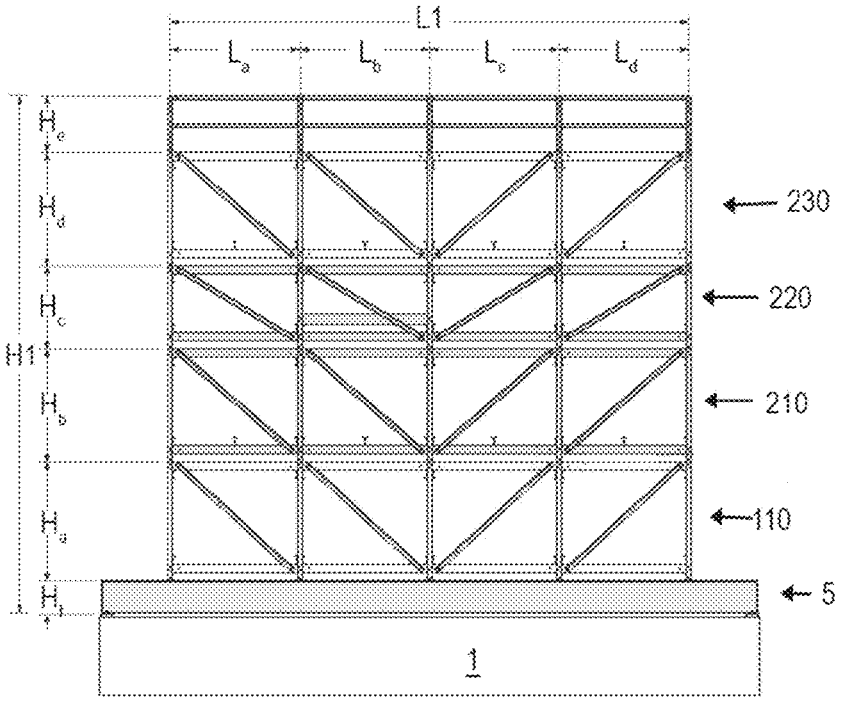
FIG. 31 is a side elevation view of a cell plan for an embodiment of the modular cooling tower cell of the present invention.
Figure 32:
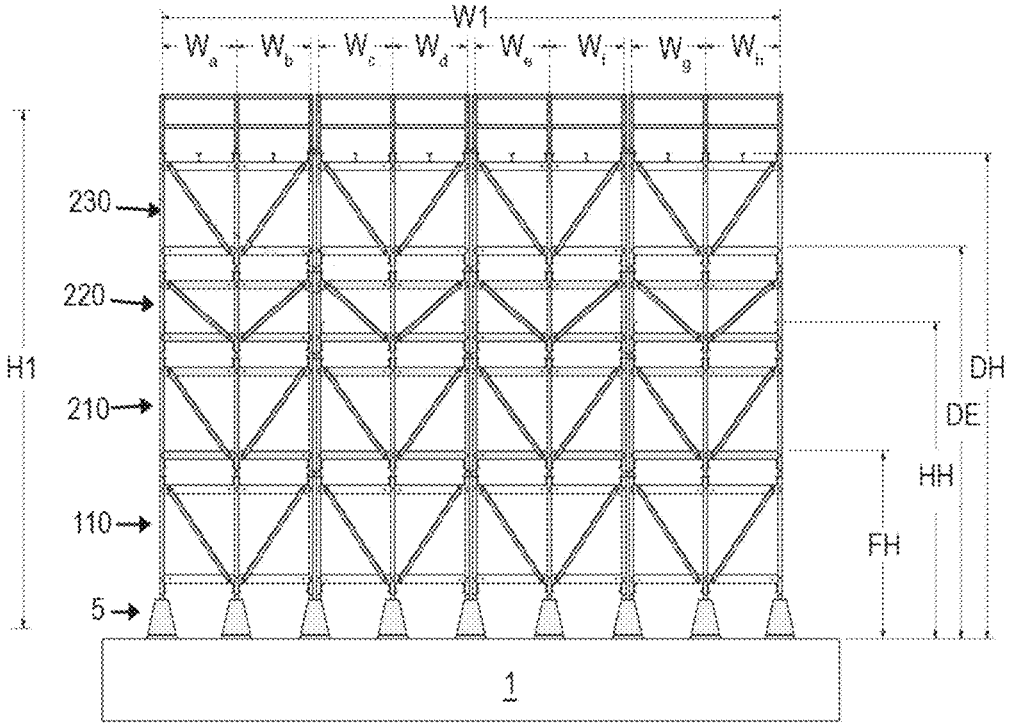
FIG. 32 is a side elevation view of a cell plan for an embodiment of the modular cooling tower cell of the present invention.

The modules 20 forming any module layer may be secured to adjacent modules via fasteners such as a carriage bolt or threaded rod to prevent racking during construction and improve the rigidity of the structure. In one embodiment, adjacent modules may be secured together via a strut block, as depicted in FIG. 27. Strut block 90 may be placed between adjacent modules 20 which form a cooling tower cell layer to provide linear support and allows for thermal expansion and contraction between modules during operation of the cooling tower cell. Strut block 90 provides for an exact spacer to secure adjacent modules.

Figure 2:
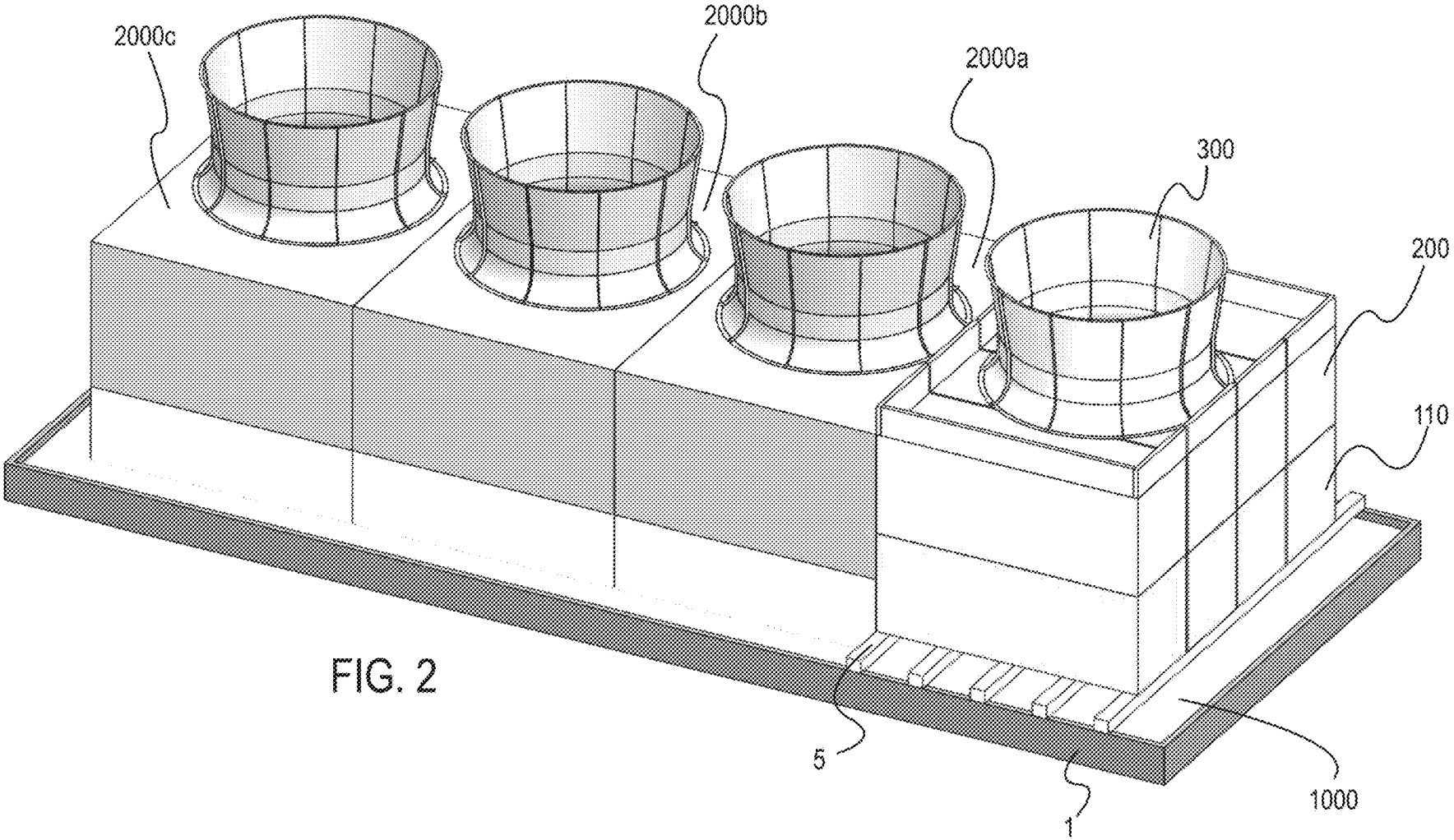
FIG. 2 is a perspective view of a completed modular cooling tower of the present invention.

After completion of the cell basin section 100 and structural framework section 200, the stack section 300 may be completed, and the water distribution system 201 of the modular cell can be connected to the inlet piping of the former cooling cell. The mechanicals may include equipment such as the fan stack, fan assembly and hub, torque tube, gear box, motor and other related mechanical equipment, and may be equipment recycled from the former cooling tower cell, if desired. The customizable dimensions of the modular cooling tower of the present invention thus allow retrofitting existing mechanicals. Due to the modular construction of the cooling tower described herein and utilization of former cooling tower cell mechanicals, the time needed to construct a fully operational cooling tower cell is significantly decreased, which minimizes downtime within the cooling tower field. After the mechanicals have been installed, the exterior of the cooling tower structural framework section 200 is wrapped with siding 61, which may be of sheet metal construction or fiberglass siding to further improve the insulation of the cooling tower during operation to improve efficiency. After completion of siding 61, other miscellaneous components such as structural safety components are added to the cooling tower. Once fully constructed, the cooling tower may be finally connected to the prior cooling tower field 2000, as depicted in FIG. 2.

The method of construction and manufacture of the present invention is an improvement over prior methods of installation. The method of the present invention allows manufacture and assembly work on the replacement tower to be ongoing at the manufacture site while the site is being readied at the second location. Unlike prior art construction of cooling towers, the present invention can replace a single cooling tower in-situ in as little as six (6) weeks. Much of this time (about four weeks) is factory assembly time for the modular cooling towers of the present invention, requiring as little as two (2) weeks to complete site assembly. Similarly, the spreader platform and lift members of the present invention allow for assembly of a modular, custom created cooling tower cell which may be replaced in-situ during operation of an existing cooling tower field. Once the foundation beams are installed, the lift members may be removed from the modular construction, thereby allowing a quick and secure means to install (and stack) further modular construction pieces. Due to the modular construction, the present invention can be retrofit with existing mechanicals, allowing alignment with a previous pump system, eliminating the need to replace existing systems. The modular bolt holes throughout the entire lug structure allow for efficient automation and robotic fabrication, and the modular design philosophy of the present invention may modularize any existing cooling tower cell of any dimension. Thus, the present invention allows in-situ construction achieved with the elimination of basin anchored, vertical columns, which normally operate in a live water basin. The modular cooling tower of the present invention further improves thermal performance, site safety, quality and achieves reduced field construction.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of assembling in-situ a cooling tower within a cooling field, comprising:

(a) removing a single cooling tower cell in a cooling tower field having a plurality of cooling tower cells, including removing vertical columns which form an original structure of said single cooling tower cell, exposing said cooling tower cell basin footing;

(b) providing a lifting device with a spreader platform comprising carrier beams and lifting cables secured to said carrier beams at one end and said lifting device at an opposite end, wherein the spreader platform is capable of supporting, balancing and lifting objects below the spreader platform by lift members to be attached to the spreader platform via securing members;

(c) providing a plurality of foundation beams each comprising an elongated member having a longitudinal axis, a first end, a second end opposite said first end, a top surface, and a bottom surface opposite said top surface, said top surface and said bottom surface extending along said longitudinal axis between said first end and said second end, said top surface including securing members extending from said top surface in a direction perpendicular to said longitudinal axis;

(d) attaching said securing members to said lift members, thereby securing at least one of said plurality of foundation beams to said lift members;

(e) lifting the spreader platform with the lift member to thereby lift said spreader platform and the at least one of said plurality of foundation beams;

(f) while lifted, moving the spreader platform and the at least one of said plurality of foundation beams to a site location above said exposed basin footing;

(g) lowering the at least one of said plurality of foundation beams to said site location; and (h) detaching said lift members from said securing members.

2. The method of claim 1, wherein the spreader platform further comprises lift beams transverse to said carrier beams.

3. The method of claim 1, further including the steps of:

(i) providing a first framework structure of a modular cooling tower cell, comprising a rectangular framework structure and vertical members each having a top and a bottom end and an axis in the vertical direction, fitting lug projections extending from said vertical member top end along said vertical axis, and receiving lugs on said bottom end of said vertical members, wherein said fitting lug projections are sized to be fitted with complementary receiving lugs of a second framework structure to secure said first framework structure to said second framework structure, and wherein said receiving lugs are sized to be fitted with said securing members of the at least one of said plurality of foundation beams to secure said rectangular framework structure to the at least one of said plurality of foundation beams;

(j) inserting said fitting lug projections within said lift members, thereby securing said first framework structure to said lift members;

(k) lifting the spreader platform with the lift member to thereby lift said spreader platform and said first framework structure;

(l) while lifted, moving the spreader platform and the first framework to a position above the at least one of said plurality of foundation beams;

(m) lowering said first framework structure onto the at least one of said plurality of foundation beams, and subsequently aligning said securing members with said receiving lugs of said first framework structure;

(n) inserting said securing members within said receiving lugs of said first framework, thereby securing said first framework to said at least one foundation beam; and (o) detaching said lift members from said fitting lug projections.

4. The method of claim 3, further comprising:

(p) providing a second framework structure of the modular cooling tower cell, said second framework structure comprising a rectangular framework of the cooling tower cell, having a top end, a bottom end, and second framework vertical members each having a top end and a bottom end and an axis in the vertical direction, lifting lug projections extending from said second framework structure vertical member top end along said vertical axis, and receiving lugs on said bottom end of said second framework structure vertical member;

(q) inserting said lifting lug projections within said lift members, thereby securing said second framework structure to said lift members;

(r) lifting the spreader platform with the lift member to thereby lift said spreader platform and said second framework structure;

(s) while lifted, moving the spreader platform and the second framework structure to a position above said first framework structure;

(t) lowering said second framework onto said first framework structure, and subsequently aligning said fitting lug projections with said receiving lugs of said second framework structure;

(u) inserting said fitting lug projections within said receiving lugs of said second framework structure, thereby securing said second framework structure to said first framework structure; and (v) detaching said lift members from said lifting lug projections.

5. The method of claim 1, wherein the lift members are connected to said spreader platform by a braided metal cable.

6. The method of claim 1, wherein the site location is said basin footing having a length and a width and wherein said step (g) includes securing the at least one of said plurality of foundation beams across the width of said basin footing such that the at least one of said plurality of foundation beams is elevated above a water level on said basin footing.

7. The method of claim 1, wherein the method may be completed while at least one of said plurality of cooling tower cells in said cooling tower field remain operational.

* * * * *